US010017863B2

(12) United States Patent
Abys et al.

(10) Patent No.: US 10,017,863 B2
(45) **Date of Patent: *Jul. 10, 2018**

(54) CORROSION PROTECTION OF BRONZES

(76) Inventors: Joseph A. Abys, Warren, NJ (US); Shenliang Sun, Bethany, CT (US); Edward J. Kudrak, Morganville, NJ (US); Katrin Zschintzsch, Solingen (DE); Theodore Antonellis, Bethany, CT (US)

( * ) Notice: Subject to any disclaimer, the term of this patent is extended or adjusted under 35 U.S.C. 154(b) by 1938 days.

This patent is subject to a terminal disclaimer.

(21) Appl. No.: 11/766,642

(22) Filed: Jun. 21, 2007

(65) Prior Publication Data

US 2008/0314283 A1 Dec. 25, 2008

(51) Int. Cl.

| | |
|---|---|
| ***C23F 11/00*** | (2006.01) |
| ***C23F 11/10*** | (2006.01) |
| ***C23C 22/03*** | (2006.01) |

(52) U.S. Cl.

CPC ..... *C23F 11/10* (2013.01); *C23C 22/03* (2013.01)

(58) Field of Classification Search

CPC ..... C23F 11/10; C23C 22/03
USPC ..... 106/14.05–14.45
See application file for complete search history.

(56) References Cited

U.S. PATENT DOCUMENTS

| | | | | |
|---|---|---|---|---|
| 2,080,299 | A * | 5/1937 | Benning et al. | 148/246 |
| 3,051,595 | A | 8/1962 | Fullhart, Jr. et al. | |
| 3,200,004 | A | 8/1965 | Herbst et al. | |
| 3,272,662 | A | 9/1966 | Herbst et al. | |
| 3,365,312 | A | 1/1968 | Nowack | |
| 3,397,150 | A | 8/1968 | Burt et al. | |
| 3,398,003 | A | 8/1968 | Smith et al. | |
| 3,630,790 | A * | 12/1971 | Schmidt et al. | 148/248 |
| 3,837,803 | A * | 9/1974 | Carter et al. | 422/13 |
| 3,837,964 | A | 9/1974 | Cotton et al. | |
| 3,986,967 | A | 10/1976 | Okorodudu | |
| 4,000,012 | A | 12/1976 | Burrows et al. | |
| 4,006,026 | A | 2/1977 | Dahms | |
| 4,052,160 | A * | 10/1977 | Cook et al. | 422/15 |
| 4,165,334 | A | 8/1979 | Gosselink et al. | |
| 4,178,253 | A | 12/1979 | Lee et al. | |

(Continued)

FOREIGN PATENT DOCUMENTS

| | | | |
|---|---|---|---|
| EP | 0492487 | A1 | 7/1992 |
| EP | 0520649 | A2 | 12/1992 |

(Continued)

OTHER PUBLICATIONS

Abstract of JP2004042050; Feb. 12, 2004.

(Continued)

*Primary Examiner* — Shuangyi Abu Ali
(74) *Attorney, Agent, or Firm* — Carmody Torrance; Sandak & Hennessey LLP

(57) ABSTRACT

A method and composition for enhancing corrosion resistance, wear resistance, and contact resistance of a substrate comprising a copper or copper alloy surface. The composition comprises a phosphorus oxide compound selected from the group consisting of a phosphonic acid, a phosphonate salt, a phosphonate ester, a phosphoric acid, a phosphate salt, a phosphate ester, and mixtures thereof; a nitrogen-containing organic compound selected from the group consisting of primary amine, secondary amine, tertiary amine, and aromatic heterocycle comprising nitrogen; and an alcohol.

11 Claims, 20 Drawing Sheets

(56) References Cited

U.S. PATENT DOCUMENTS

| | | | | |
|---|---|---|---|---|
| 4,181,619 | A | 1/1980 | Schmitt et al. | |
| 4,209,487 | A | 6/1980 | Hogue et al. | |
| 4,252,662 | A | 2/1981 | Marolewski et al. | |
| 4,255,148 | A | 3/1981 | Reinwald et al. | |
| 4,257,828 | A | 3/1981 | Wada et al. | |
| 4,303,568 | A | 12/1981 | May et al. | |
| 4,329,381 | A | 5/1982 | Eschwey et al. | |
| 4,350,600 | A | 9/1982 | Sharp et al. | |
| 4,357,396 | A | 11/1982 | Grunewalder et al. | |
| 4,395,294 | A | 7/1983 | Hobbins et al. | |
| 4,649,025 | A | 3/1987 | Hwa et al. | |
| 4,734,257 | A * | 3/1988 | Penninger | 422/13 |
| 4,744,950 | A | 5/1988 | Hollander | |
| 4,865,927 | A | 9/1989 | Leig-Horstebrock et al. | |
| 4,873,139 | A | 10/1989 | Kinosky et al. | |
| 4,908,241 | A | 3/1990 | Quast et al. | |
| 5,030,373 | A | 7/1991 | Kimura et al. | |
| 5,064,723 | A | 11/1991 | Lawson | |
| 5,091,113 | A | 2/1992 | Clubley | |
| 5,103,550 | A | 4/1992 | Wefers et al. | |
| 5,141,675 | A | 8/1992 | Vanderpool et al. | |
| 5,178,916 | A | 1/1993 | Chidsey et al. | |
| 5,226,956 | A | 7/1993 | Askew et al. | |
| 5,300,247 | A | 4/1994 | Emerich et al. | |
| 5,302,304 | A | 4/1994 | Valcho | |
| 5,364,460 | A | 11/1994 | Morimoto et al. | |
| 5,368,758 | A | 11/1994 | Gapinski | |
| 5,463,804 | A | 11/1995 | McCleary et al. | |
| 5,487,792 | A | 1/1996 | King et al. | |
| 5,555,756 | A | 9/1996 | Fischer et al. | |
| 5,618,634 | A | 4/1997 | Hosoda et al. | |
| 5,650,385 | A | 7/1997 | Dunn et al. | |
| 5,795,409 | A | 8/1998 | Hirao et al. | |
| 5,853,797 | A | 12/1998 | Fuchs et al. | |
| 5,980,619 | A | 11/1999 | Braig et al. | |
| 6,102,521 | A | 8/2000 | Halko et al. | |
| 6,117,795 | A | 9/2000 | Pasch | |
| 6,139,610 | A | 10/2000 | Sinko | |
| 6,183,815 | B1 | 2/2001 | Enick et al. | |
| 6,248,701 | B1 | 6/2001 | Church | |
| 6,375,822 | B1 | 4/2002 | Taytsas | |
| 6,383,414 | B1 | 5/2002 | Pasch | |
| 6,395,329 | B2 | 5/2002 | Soutar et al. | |
| 6,461,682 | B1 | 10/2002 | Crotty et al. | |
| 6,586,167 | B2 | 7/2003 | Katoh et al. | |
| 6,599,445 | B2 | 7/2003 | Meyer | |
| 6,627,329 | B1 | 9/2003 | Shintani | |
| 6,646,082 | B2 | 11/2003 | Ghosh et al. | |
| 6,731,965 | B2 | 5/2004 | Menon et al. | |
| 6,773,757 | B1 | 8/2004 | Redline et al. | |
| 6,803,349 | B2 | 10/2004 | Negoro et al. | |
| 6,863,718 | B2 | 3/2005 | Lamborn et al. | |
| 6,869,637 | B2 | 3/2005 | Hutchinson et al. | |
| 6,905,587 | B2 | 6/2005 | Redline et al. | |
| 6,911,490 | B2 | 6/2005 | Feola et al. | |
| 6,923,692 | B2 | 8/2005 | Niebauer | |
| 6,933,046 | B1 | 8/2005 | Cook | |
| 7,399,801 | B2 | 7/2008 | Tsuji et al. | |
| 7,524,535 | B2 | 4/2009 | Kim et al. | |
| 7,883,738 | B2 * | 2/2011 | Abys | C23C 22/03 427/58 |
| 2002/0011280 | A1 | 1/2002 | Nitowski | |
| 2004/0048486 | A1 | 3/2004 | Bernards et al. | |
| 2005/0181225 | A1 | 8/2005 | Destarac et al. | |
| 2005/0217757 | A1 | 10/2005 | Miyano | |
| 2005/0239295 | A1 | 10/2005 | Wang et al. | |
| 2006/0024430 | A1 | 2/2006 | Yau et al. | |
| 2007/0001150 | A1 * | 1/2007 | Hudgens et al. | 252/390 |
| 2007/0075120 | A1 | 4/2007 | Yang et al. | |
| 2007/0092640 | A1 | 4/2007 | Burner et al. | |
| 2007/0256590 | A1 * | 11/2007 | Scott et al. | 106/1.05 |
| 2008/0108539 | A1 * | 5/2008 | Kany et al. | 510/402 |
| 2010/0151263 | A1 | 6/2010 | Abys et al. | |
| 2010/0319572 | A1 | 12/2010 | Abys et al. | |

FOREIGN PATENT DOCUMENTS

| | | | | |
|---|---|---|---|---|
| GB | 1209778 | | 10/1970 | |
| GB | 1396795 | A | 6/1975 | |
| GB | 2331942 | A | 6/1999 | |
| JP | 57198269 | A | 12/1982 | |
| JP | 2004042050 | | 2/2004 | |
| WO | 9619097 | | 6/1996 | |
| WO | 9718905 | A1 | 5/1997 | |
| WO | 03029227 | A1 | 4/2003 | |
| WO | WO2005/103334 | * | 3/2005 | C23F 11/167 |
| WO | 2007/120259 | A2 | 10/2007 | |
| WO | 2008131206 | A1 | 10/2008 | |

OTHER PUBLICATIONS

Abstract of JP57198269; Dec. 4, 1982.

Tompkins et al., "The Interaction of Imidazole, Benzimidazole and Related Azoles with a Copper Surface", Surface and Interface Analysis, vol. 4, Issue 6, Dec. 1982, pp. 261-266.

Song et al., "Synthesis and Characterization of Water-Soluble Polymeric Adhesion Promoter for Epoxy Resin/Copper Joints", Journal of Applied Polymer Science, vol. 85 Issue 10, Sep. 2002, pp. 2202-2210.

Song et al., "Adhesion Improvement of Epoxy Resin/Copper Lead Frame Joints by Azole Compounds", Journal of Adhesion Science and Technology, vol. 12, No. 5, 1998, pp. 541-561.

Xue, Gi, et al., "Various Adsorption States of 2-Mercaptobenzimidazole on the Surface of Gold and Silver Studied by Surface Enhanced Raman Scattering", Langmuir, 1994, pp. 967-969, vol. 10, No. 3.

Xue, Gi, et al., "Surface Reaction of 2-Mercaptobenzimidazole on Metals and its application in Adhesion Promotion", Journal of the Chemical Society Faraday Transactions, 1991, pp. 1229-1232, vol. 87, No. 8.

Trachli, B., et al., "Protective Effect of Electropolymerized 2-Mercaptobenzimidazole upon Copper Corrosion", Progress in Organic Coating, 2002, pp. 17-23, vol. 44.

Assouli, B. et al., "Effect of 2-mercaptobenzimidazole and its Polymeric Film on the Corrosion Inhibition of Brass (60/40) in Ammonia Solution", Corrosion Science, 2004, pp. 399-407, vol. 60, No. 4.

Perrin, F. X. et al., "Characterization and Mechanism of Direct Film Formation on a Cu electrode through electro-oxidation of 2-mercaptobenzimidazole", Corrosion Science, 1998, pp. 1647-1662, vol. 40, No. 10.

Makhlouf et al., "The Synergistic Effect of Halide Ions and Some Selected Thiols as a Combined Corrosion Inhibitor for Pickling ff Mild Steel in Sulphuric Acid Solution", Materials Chemistry and Physics, 1996, pp. 76-82, vol. 43, No. 1.

Mazurkiewicz, Paul, "Accelerated Corrosion of Printed Circuit Boards due to High Levels of Reduced Sulfur Gasses in Industrial Environments", Proceedings of the 23rd International Symposium for Testing and Failure Analysis, Nov. 12-16, 2006, Renaissance Austin Hotel, Austin Texas, USA, pp. 469-473.

Parikh, Atul et al., "An Intrinsic Relationship between Molecular Structure in Self-Assembled n-Alkylsiloxane Monolayers and Deposition Temperature", Journal of Physical Chemistry 1994, 1 page, vol. 98.

Cullen, Donald, "Surface Tarnish and Creeping Corrosion on Pb-Free Circuit Board Finishes", 8 pages, <http://members.ipc.org/IPCLogin/IPCMembers/IPC/Review/0106/0106TechArt.pdf>.

Veale, Robert, "Reliability of PCB Alternate Surface Finishes in a Harsh Industrial Environment", Proceedings of the SMTA International Conference, Sep. 25, 2005, 6 pages.

International Search Report, PCT/US08/67341, dated Sep. 19, 2008, 3 pages.

Written Opinion, PCT/US08/67341, dated Sep. 19, 2008, 7 pages.

Extended European Search Report, Application No. 08771362.4, dated Apr. 24, 2015, 10 pages.

* cited by examiner

CORROSION PROTECTION OF BRONZES

FIELD OF THE INVENTION

This invention relates to methods and compositions which improve wear resistance, corrosion resistance, and contact resistance of copper and copper alloys and in particular to improvement of wear resistance, corrosion resistance, and contact resistance of bronzes.

BACKGROUND OF THE INVENTION

Metallic surface coatings are commonly applied to electronic devices and decorative objects to provide corrosion protection and other desired functional properties. Bronzes are commonly used as a surface coating in a wide variety of consumer and electronic products, such as fasteners, jewelry, musical instruments, electrical connectors, bearings, fittings, tools, and so on. Bronze coatings are especially attractive as an alternative to nickel coating, since nickel is a well-known allergan.

Bronzes are commonly used as a top coat or under coat for palladium, palladium-nickel, silver, and gold objects. Final deposits offer excellent corrosion resistance, wear resistance, solderability, and a low coefficient of friction.

SUMMARY OF THE INVENTION

Briefly, the invention is directed to a composition for enhancing corrosion resistance, wear resistance, and contact resistance of a metal substrate comprising a copper or copper alloy layer on a surface thereof, the composition comprising a phosphorus oxide compound selected from the group consisting of a phosphonic acid, a phosphonate salt, a phosphonate ester, a phosphoric acid, a phosphate salt, a phosphate ester, and mixtures thereof; a nitrogen-containing organic compound selected from the group consisting of primary amine, secondary amine, tertiary amine, and aromatic heterocycle comprising nitrogen; and an alcohol having a boiling point of at least about 90° C.

In another aspect, the invention is directed to a method for enhancing corrosion resistance, wear resistance, and contact resistance of a metal substrate comprising a copper or copper alloy layer on a surface thereof, the method comprising contacting the substrate with the foregoing composition.

Other objects and features of the invention will be in part apparent and in part pointed out hereinafter.

DETAILED DESCRIPTION OF EMBODIMENT(S) OF THE INVENTION

Figure 1A:
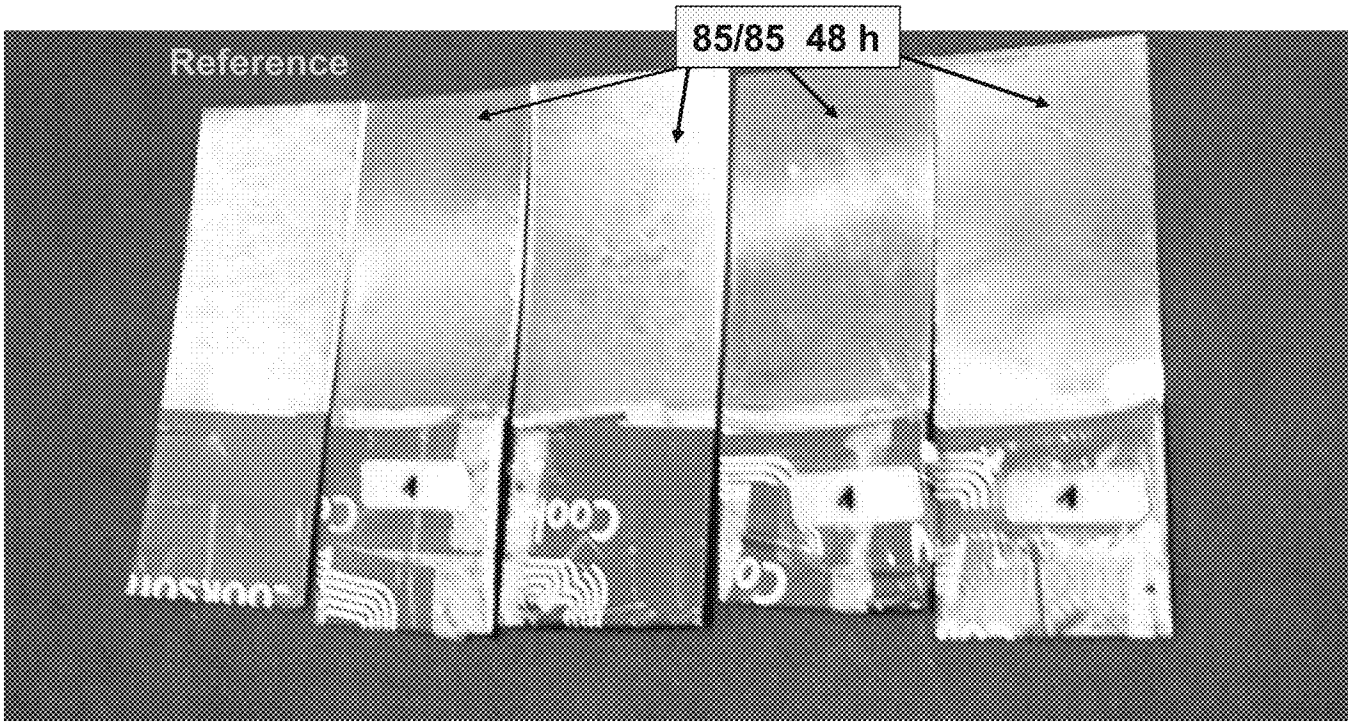
FIGS. 1A through 1G are photographs of bronze coated coupons subjected to humidity testing according to the method of Example 9.
Figure 1B:
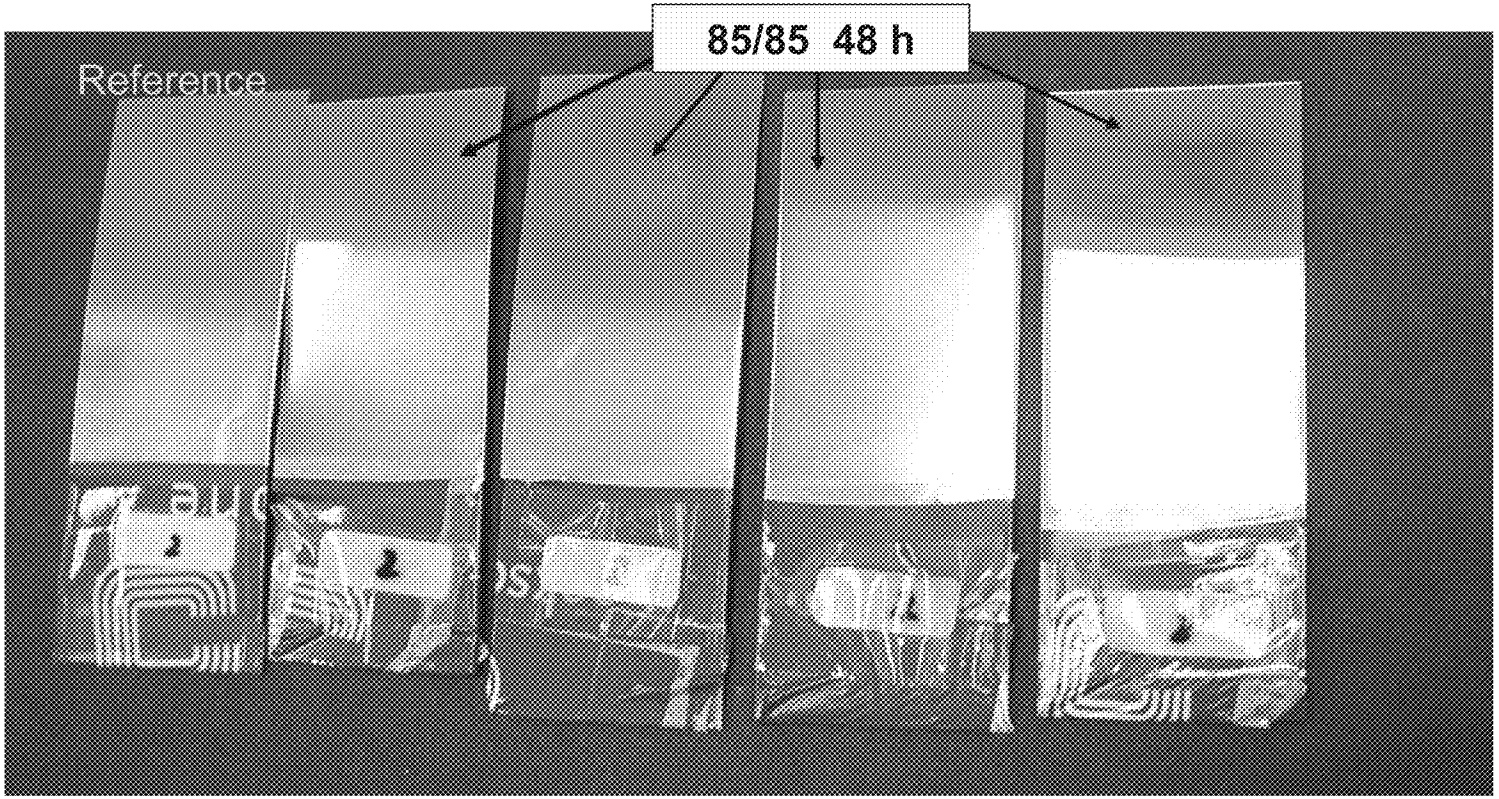
Figure 1C:
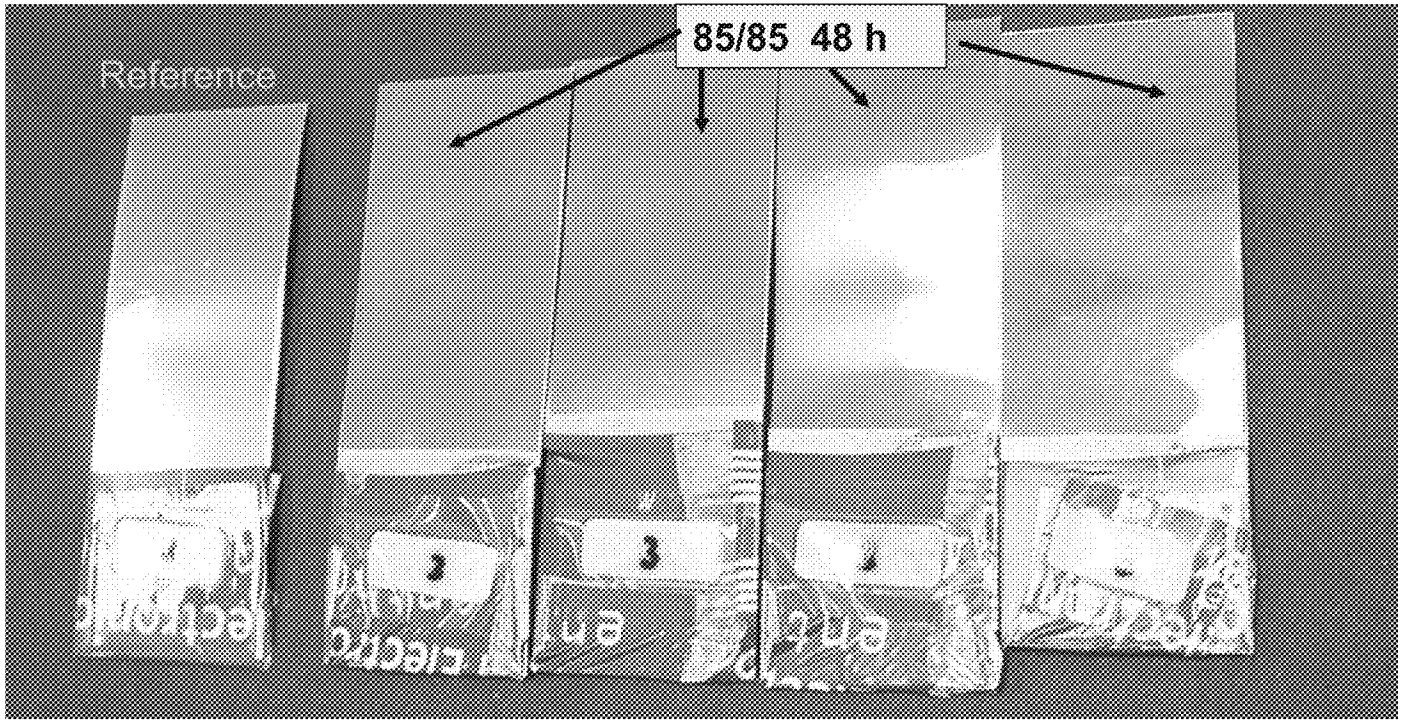
Figure 1D:
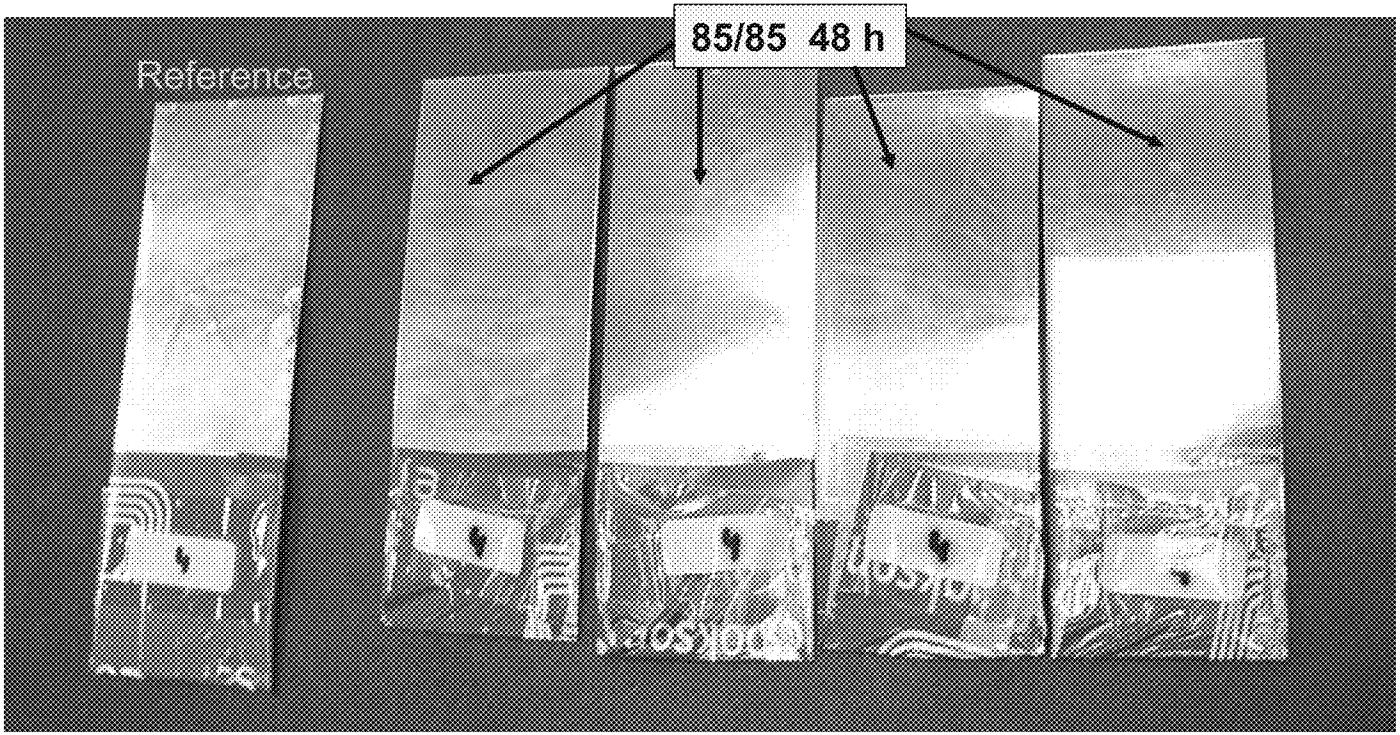
Figure 1E:
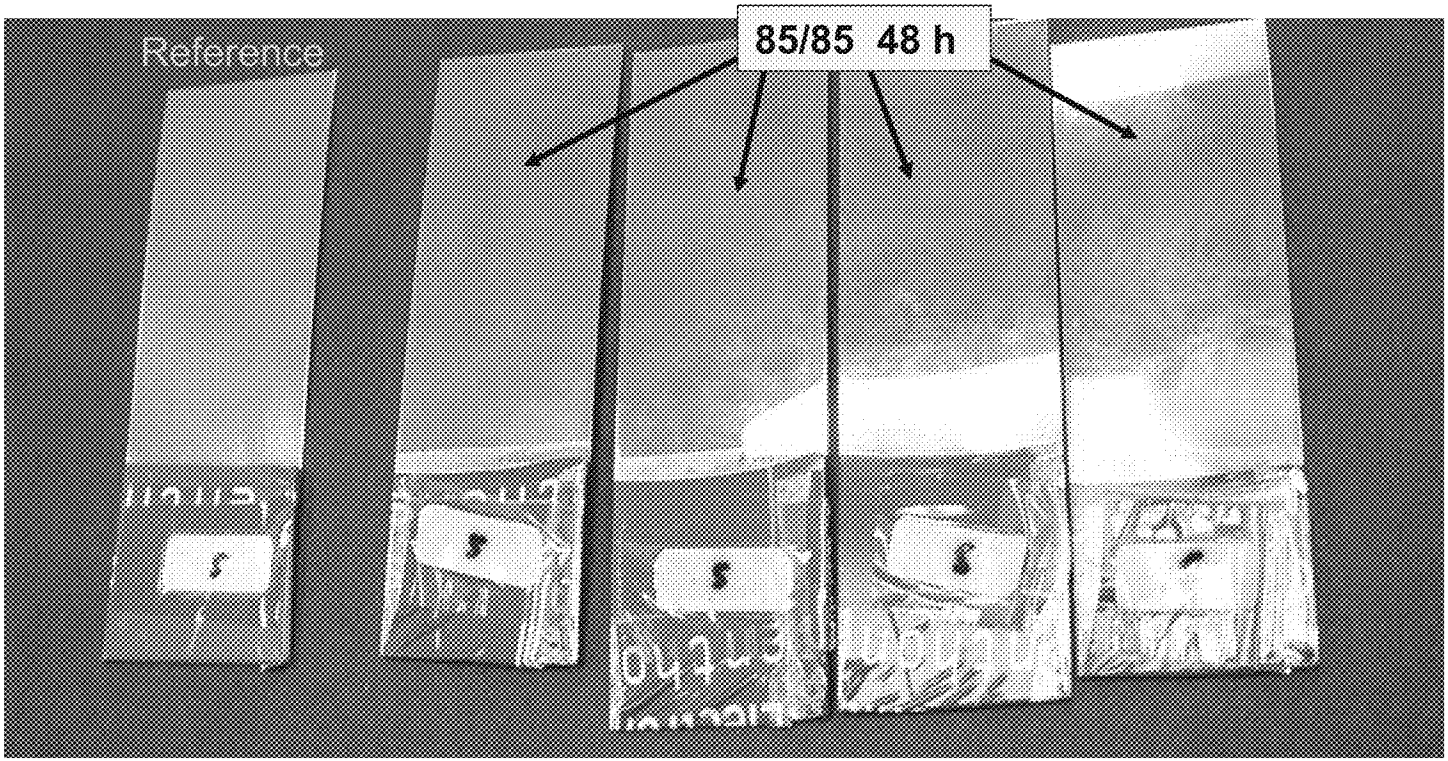
Figure 1F:
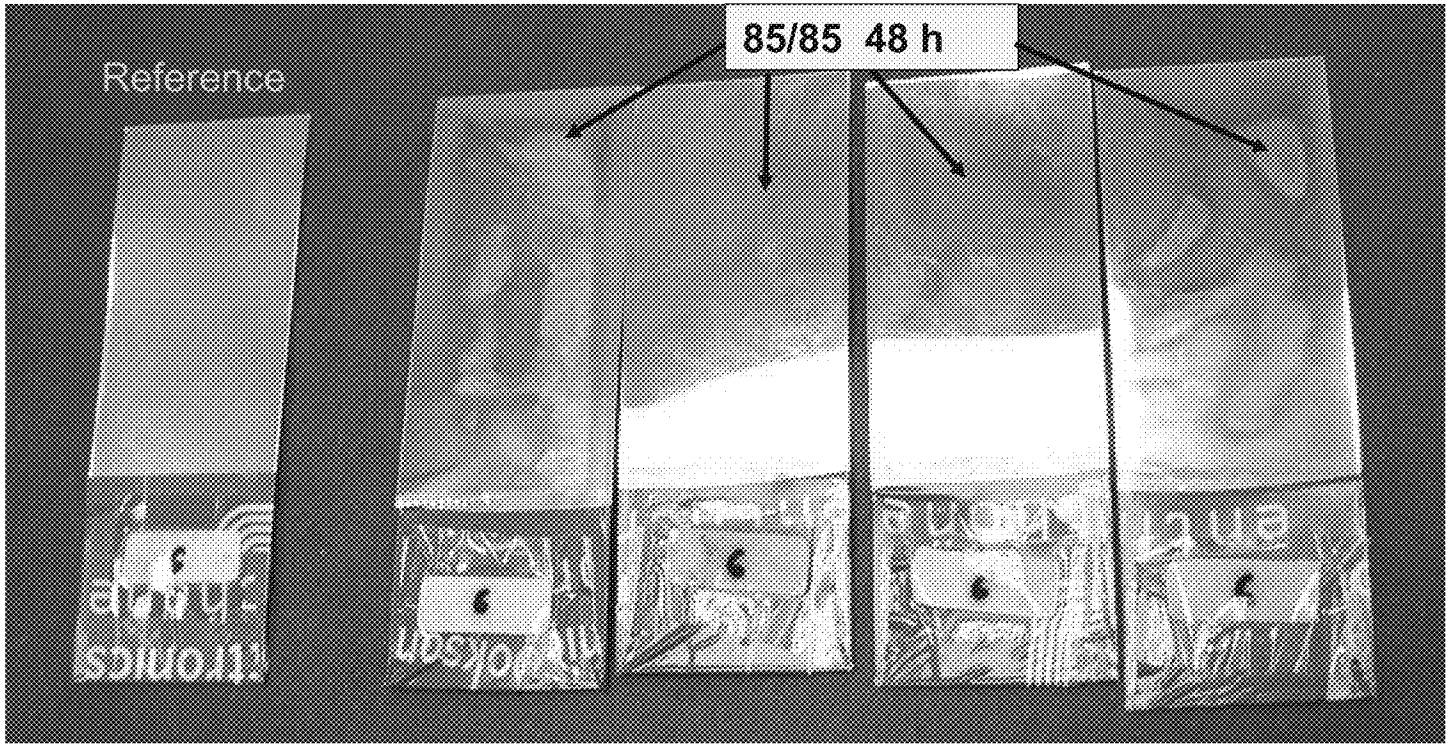

The present invention is directed to a surface treatment method and a surface treatment composition for applying a protective organic film to a copper or copper alloy surface coating. In one embodiment, the copper alloy surface coating is a bronze surface coating. The surface treatment has been found effective in enhancing the corrosion resistance, contact resistance, and wear resistance of bronze surface coatings.

The surface treatment method comprises exposing the copper or copper alloy surface coating to a surface treating composition comprising organic additives that form a self-assembled monolayer over the surface of the copper or copper alloy and also penetrates into any pores that may be present in the copper-based surface coating. Accordingly, the compositions of the present invention can effectively block pores down to the underlying substrate. This enhanced pore blocking combined with the surface self-assembled monolayer is effective for inhibiting corrosion, enhancing wear resistance, decreasing contact resistance, and prolonging the useful service life of consumer products and electronic devices coated with a copper or a copper alloy surface coating, such as a bronze.

Surfaces that may be protected by the method of the present invention include copper and copper alloy surfaces, particularly bronze surface coatings. A wide variety of bronzes are known. The most common bronzes comprise an alloy of copper and tin. The tin content can vary widely in copper-tin bronzes, typically from as little as about 3% by weight up to about 45% by weight. The color of the bronze depends upon the amount of tin present. For example, when the tin content is between about 30% by weight and about 45% by weight, the bronze is silver in color, and these bronzes are called "white" bronzes. White bronzes are relatively soft. When the tin content is between about 15% by weight and about 30% by weight, the bronze takes a yellow gold coloring. Such bronzes are referred to as "yellow" bronzes. When the tin content is between about 3% by weight and about 15% by weight, the bronze is red-gold colored. These bronzes are referred to as "red" bronzes.

Also applicable are the so-called phosphor bronzes. Phosphor bronzes have a relatively low tin content, typically between about 2% by weight and about 5% by weight, such as about 3.5% by weight and a phosphorus content up to about 1% by weight. These alloys are notable for their toughness, strength, low coefficient of friction, and fine grain. The phosphorus also improves the fluidity of the molten metal and thereby improves the castability, and improves mechanical properties by cleaning up the grain boundaries. Phosphor bronze is used for springs and other applications where resistance to fatigue, wear, and chemical corrosion is required. It is also used in acoustic instrument strings.

The copper alloy may be an alloy commonly known as a brass, such as alloys with zinc as the principal alloying element. Brasses further include alloys comprising copper, zinc, and tin. Brass has higher malleability than copper or zinc. The relatively low melting point (900-940° C. depending on composition) of brass and its flow characteristics make it a relatively easy material to cast. By varying the proportions of copper and zinc, the properties of the brass can be changed, allowing hard and soft brasses. The amount of zinc in a brass alloy may vary widely, typically from 5% by weight up to 50% by weight. When tin is included, the concentration is typically low, such as between about 1% by weight and about 5% by weight.

Also applicable for protection according to the method of the present invention are the aluminum bronzes. Aluminum bronzes contain aluminum as the principal alloying elements. Aluminum bronzes are characterized by high strength and corrosion resistance compared to other bronze alloys. These alloys are tarnish-resistant and show low rates of corrosion in atmospheric conditions, low oxidation rates at high temperatures, and low reactivity with sulfurous compounds and other exhaust products of combustion. They are also resistant to corrosion in sea water. These improved properties are achieved with the aluminum component, which reacts with atmospheric oxygen to form a thin, tough surface layer of alumina (aluminum oxide) which acts as a barrier to corrosion of the copper-rich alloy. The aluminum content typically varies from 5% by weight to 11% by weight. Aluminum bronzes may comprise small amounts of other elements, typically iron, nickel, manganese, and silicon in amounts varying from 0.5% by weight up to 6% by weight.

These and other copper and copper alloys may be applied as top coats over a wide variety of metals. In particular, copper and copper alloys are typically applied to nickel-based, iron-based substrates, and precious metal substrates. Iron-based substrates include steel, which encompasses a wide variety of iron alloys with carbon, manganese, tungsten, molybdenum, chromium, or nickel in amounts up to about 10% by weight. Common steels include between about 0.02% and 2.1% by weight carbon. Also applicable are steels having up to about 2% by weight manganese, typically 1.5% by weight.

The present invention is further directed to a surface treatment composition for the protection of copper and copper alloy surface coatings. The surface treatment composition for use in the surface treatment of the present invention comprises a phosphorus oxide compound, an aromatic heterocycle comprising nitrogen, and a high boiling solvent.

The surface treating composition of the present invention comprises a phosphorus oxide compound. The phosphorus oxide compound is added to the surface treatment composition to react with and impart a protective organic film over any metal that may be present on the surface of the copper alloy or any metal (i.e., substrate metal) that may be exposed due to incomplete surface coverage of the copper-based topcoat, such as through pores which may be present in a bronze topcoat. For example, tin, the principal alloying element in bronze, forms surface oxides and hydroxides. Moreover, nickel, a metal commonly coated by copper and copper alloy layers, also forms surface oxides and hydroxides. Advantageously, surface oxides and hydroxides react with phosphorous oxide compounds to form a chemical bond between the oxide and hydroxide and phosphorus oxide compound. The reaction between tin hydroxides and an exemplary phosphorus oxide occurs as shown:

$$Sn(OH)_{2(s)}+2R—PO_3H_{(aq)}=>Sn—(O—PO_2—R)_2+2H_2O$$

Phosphorus oxides may react with nickel hydroxides similarly. Each phosphorus oxide having the general structure shown in the above reaction can react with one, two, or three oxygen atoms on the surface of the base metal layer. The reaction causes the phosphorus oxide compound to be chemically bonded to the oxide on the top coat surface while also filling in pores and forming a protective organic coating over other areas of exposed substrate. In this regard, it is to be noted that phosphorus oxides react with oxides and hydroxides of tin, nickel, zinc, chromium, iron, and titanium, among other metals.

Phosphorus oxide compounds suitable for adding to the surface treating compositions of the present invention preferably have a structure similar to micellular surfactants, i.e., having a hydrophilic head group and a hydrophobic component. As stated above, the hydrophilic head group comprising the phosphorus oxide moiety reacts with and bonds to metal oxides and hydroxides in a self-assembling reaction. The hydrophobic component forms a densely packed hydrophobic film on the surface of the top coat and substrate that repels water and environmental humidity. Accordingly, the phosphorus oxide compounds preferably comprise phosphate or phosphonate moieties bonded to a hydrophobic group. For example, the hydrophobic group bonded to the phosphate or phosphonate moiety can be an alkyl group, an aryl group, an arylalkyl, or an alkylaryl group.

An exemplary phosphorus oxide compound is a phosphonate derivative having the following general structure (I):

Structure (I)

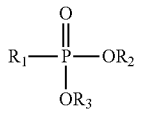

wherein $R_1$ is a hydrocarbyl having between one carbon atom and 24 carbon atoms; and $R_2$ and $R_3$ are each independently or together hydrogen, a charge balancing cation, or a hydrocarbyl having between one carbon atom and four carbon atoms. The $R_1$ hydrocarbyl may be branched-chained or straight-chained, substituted or unsubstituted. The $R_1$ hydrocarbyl may comprise alkyl, alkenyl, alkynyl, aryl, or combinations thereof, such as alkylaryl or arylalkyl. For example, the $R_1$ hydrocarbyl may comprise a phenyl group bonded to the phosphorus atom to which is bonded a hydrocarbyl chain, such as an alkyl chain having from one to 18 carbon atoms. In another example, the $R_1$ hydrocarbyl may comprise an alkyl chain having from one to 18 carbon atoms bonded to the phosphorus atom and further comprising a phenyl group. Preferably, the $R_1$ hydrocarbyl comprises an alkyl chain comprising between about two carbon atoms and about 24 carbon atoms, more preferably between about four carbon atoms and 22 carbon atoms, even more preferably between about six carbon atoms and about 18 carbon atoms, yet more preferably between about eight and about 18 carbons.

Unless otherwise indicated, a substituted hydrocarbyl is substituted with at least one atom other than carbon, including moieties in which a carbon chain atom is substituted with a hetero atom such as nitrogen, oxygen, silicon, phosphorous, boron, sulfur, or a halogen atom. The hydrocarbyl may be substituted with one or more of the following substituents: halogen, heterocyclo, alkoxy, alkenoxy, alkynoxy, aryloxy, hydroxy, protected hydroxy, hydroxycarbonyl, keto, acyl, acyloxy, nitro, amino, amido, nitro, phosphono, cyano, thiol, ketals, acetals, esters, and ethers.

$R_2$ and/or $R_3$ may be hydrogen; in this case, the phosphorus oxide compound is a phosphonic acid. $R_2$ and/or $R_3$ may be a charge balancing metal cation such as lithium, potassium, sodium, or calcium. The charge balancing cation may also be ammonium. When $R_2$ and/or $R_3$ comprise charge balancing cation, the phosphorus oxide compound is a phosphonate salt. $R_2$ and/or $R_3$ may be a hydrocarbyl such as methyl, ethyl, n-propyl, isopropyl, n-butyl, isobutyl, and tert-butyl. When $R_2$ and/or $R_3$ are hydrocarbyl, the phosphorus oxide compound is a phosphonate ester.

The phosphorus oxide compound may comprise a phosphonic acid, a phosphonate salt, a phosphonate ester, or a mixture thereof. Exemplary phosphorus oxide compounds having phosphonate moieties bonded the alkyl groups applicable for use in the surface treating compositions of the present invention include ethylphosphonic acid, n-propylphosphonic acid, isopropylphosphonic acid, n-butylphosphonic acid, tert-butylphosphonic acid, pentylphosphonic acids, hexylphosphonic acids, heptylphosphonic acids, n-octylphosphonic acid, n-decyl phosphonic acid, n-dodecyl phosphonic acid, n-tetradecyl phosphonic acid, n-hexadecyl phosphonic acid, n-octadecyl phosphonic acid, their salts, and their esters. Exemplary phosphorus oxide compounds having phosphonate moieties bonded the other hydrocarbyl types applicable for use in the surface treating compositions of the present invention include methylenediphosphonic acid, vinylphosphonic acid, allylphosphonic acid, phenyl phosphonic acid, benzyl phosphonic acid, (ortho-tolyl)phosphonic acid, (meta-tolyl)phosphonic acid, (para-tolyl)phosphonic acid, (4-ethylphenyl)phosphonic acid, (2,4-xylyl)phosphonic acid, (3,4-xylyl)phosphonic acid, (2,5-xylyl)phosphonic acid, (3,5-xylyl)phosphonic acid, their salts, and their esters. Also among the suitable compounds are, for example, bifunctional molecules such as phosphonic acid compounds comprising carboxylic acid moieties, such as phosphonoacetic acid, 3-phosphonopropionic acid, their salts, and their esters.

Another exemplary phosphorus oxide compound is a phosphate derivative having the following general structure (II):

Structure (II)

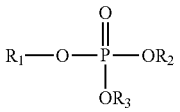

wherein $R_1$ is a hydrocarbyl having between one carbon atom and 24 carbon atoms; and $R_2$ and $R_3$ are each independently or together hydrogen, a charge balancing cation, or a hydrocarbyl having between one carbon atom and four carbon atoms. The $R_1$ hydrocarbyl may be branched-chained or straight-chained, substituted or unsubstituted. The $R_1$ hydrocarbyl may comprise alkyl, alkenyl, alkynyl, aryl, or combinations thereof, such as alkylaryl or arylalkyl. For example, the $R_1$ hydrocarbyl may comprise a phenyl group bonded to the oxygen atom to which is bonded a hydrocarbyl chain, such as an alkyl chain having from one to 18 carbon atoms. In another example, the $R_1$ hydrocarbyl may comprise an alkyl chain having from one to 18 carbon atoms bonded to the oxygen atom and further comprises a phenyl group. Preferably, the $R_1$ hydrocarbyl comprises an alkyl chain comprising between about two carbon atoms and about 24 carbon atoms, more preferably between about four carbon atoms and 22 carbon atoms, even more preferably between about six carbon atoms and about 18 carbon atoms, yet more preferably between about eight and about 18 carbons.

Unless otherwise indicated, a substituted hydrocarbyl is substituted with at least one atom other than carbon, including moieties in which a carbon chain atom is substituted with a hetero atom such as nitrogen, oxygen, silicon, phosphorous, boron, sulfur, or a halogen atom. The hydrocarbyl may be substituted with one or more of the following substituents: halogen, heterocyclo, alkoxy, alkenoxy, alkynoxy, aryloxy, hydroxy, protected hydroxy, hydroxycarbonyl, keto, acyl, acyloxy, nitro, amino, amido, nitro, phosphono, cyano, thiol, ketals, acetals, esters, and ethers.

$R_2$ and/or $R_3$ may be hydrogen; in this case, the phosphorus oxide compound is a phosphoric acid. $R_2$ and/or $R_3$ may be a charge balancing metal cation such as lithium, potassium, sodium, or calcium. The charge balancing cation may also be ammonium. When $R_2$ and/or $R_3$ comprise charge balancing cation, the phosphorus oxide compound is a phosphate salt. The $R_2$ and/or $R_3$ may be a hydrocarbyl such as methyl, ethyl, n-propyl, isopropyl, n-butyl, isobutyl, and tert-butyl. When $R_2$ and/or $R_3$ are hydrocarbyl, the phosphorus oxide compound is a phosphate ester.

The phosphorus oxide compound may comprise a phosphoric acid, a phosphate salt, a phosphate ester, or a mixture thereof. Exemplary phosphorus oxide compounds having phosphate moieties bonded to alkyl groups applicable for use in the surface treating compositions of the present invention include ethylphosphoric acid, n-propylphosphoric acid, isopropylphosphoric acid, n-butylphosphoric acid, tert-butylphosphoric acid, pentylphosphoric acids, hexylphosphoric acids, heptylphosphoric acids, n-octylphosphoric acid, n-decyl phosphoric acid, n-undecyl phosphoric acid, n-dodecyl phosphoric acid, n-tridecyl phosphoric acid, n-tetradecyl phosphoric acid, n-hexadecyl phosphoric acid, n-octadecyl phosphoric acid, their salts, and their esters. Exemplary phosphorus oxide compounds having phosphate moieties bonded to other hydrocarbyl types applicable for use in the surface treating compositions of the present invention include allyl phosphate, diethyl phosphate, diisopropyl phosphate, dibutyl phosphate, triisobutylphosphate, phenyl phosphate, diphenyl phosphate, 1-naphthyl phosphate, 2-naphthyl phosphate, their salts, and their esters.

The phosphorus oxide compound may be added to the surface treating compositions of the present invention at a concentration between about 0.01% by weight (about 0.1 g/L) and about 10% by weight (about 100 g/L), preferably between about 0.1% by weight (about 1 g/L) and about 5% by weight (about 50 g/L), more preferably between about 0.1% by weight (about 1 g/L) and about 2% by weight (about 20 g/L), such as about 1% by weight (about 10 g/L). The phosphorus oxide compound is preferably added to the composition in at least about 0.01% by weight (about 0.1 g/L) to achieve rapid coating. The maximum concentration of about 10% by weight (about 100 g/L) is determined by the phosphorus oxide compound's solubility and therefore may be higher or lower than the stated amount depending upon the identity of the phosphorus oxide compound. In a preferred composition, the compound is n-octadecyl phosphonic acid added in a concentration between about 0.2% by weight (about 2.0 g/L) and about 2% by weight (about 20.0 g/L) for example, about 1% by weight (about 10 g/L).

The surface treating composition of the present invention further comprises a nitrogen-containing organic compound. The nitrogen-containing organic compound may be selected from among primary amine, secondary amine, tertiary amine, and aromatic heterocycle comprising nitrogen. The composition may comprise a combination such nitrogen-containing organic compounds. The nitrogen-containing organic compound is added to the surface treatment composition to react with and protect the copper or copper alloy surface. Without being bound to a particular theory, it is thought that the lone electron pair in the nitrogen atom forms a nitrogen-copper bond, thereby forming a protective organic film over the copper or copper alloy surface, wherein the film comprises a self-assembled layer of nitrogen-containing organic compounds bonded to the copper surface.

In one embodiment, the a nitrogen-containing organic compound comprises a primary amine, secondary amine, a tertiary amine, or any combination thereof, the amine having the following general structure (III):

Structure (III)

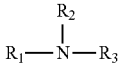

wherein $R_1$, $R_2$, and $R_3$ are each independently hydrogen or a hydrocarbyl having between one carbon atom and about 24 carbon atoms, and at least one of $R_1$, $R_2$, and $R_3$ is a hydrocarbyl having between one carbon atom and about 24 carbon atoms. The hydrocarbyl preferably comprises between about six carbon atoms and about 18 carbon atoms. The hydrocarbyl may be substituted or unsubstituted. Typical substituents include short carbon chain branching alkyl groups, typically having from one to four carbon atoms, i.e., methyl, ethyl, propyl, and butyl substituents and aromatic groups such as phenyl, naphthenyl, and aromatic heterocycles comprising nitrogen, oxygen, and sulfur. Other substituents include amines, thiols, carboxylates, phosphates, phosphonates, sulfates, sulfonates, halogen, hydroxyl, alkoxy, aryloxy, protected hydroxy, keto, acyl, acyloxy, nitro, cyano, esters, and ethers. In one preferred embodiment, one of $R_1$, $R_2$, and $R_3$ is an unsubstituted, un-branched alkyl and the other two of $R_1$, $R_2$, and $R_3$ are hydrogen atoms, and thus the amine is a primary amine. Primary amines comprising un-branched alkyl better achieve a desirable densely packed self-assembled monolayer over a copper surface. Exemplary primary amines applicable for use in the composition of the present invention, singly or in combination, include aminoethane, 1-aminopropane, 2-aminopropane, 1-aminobutane, 2-aminobutane, 1-amino-2-methylpropane, 2-amino-2-methylpropane, 1-aminopentane, 2-aminopentane, 3-aminopentane, neo-pentylamine, 1-aminohexane, 2-aminohexane, 1-aminoheptane, 2-aminoheptane, 1-aminooctane, 2-aminooctane, 1-aminononane, 1-aminodecane, 1-aminododecane, 1-aminotridecane, 1-aminotetradecane, 1-aminopentadecane, 1-aminohexadecane, 1-aminoheptadecane, 1-aminooctadecane, and 1-aminoeicosane.

In a preferred embodiment, the nitrogen-containing organic compound comprises an aromatic heterocycle comprising nitrogen. It appears that aromatic heterocycles comprising nitrogen additionally protect copper surfaces by interacting with copper(I) ions on the surface of the copper or copper alloy surface. Interaction with copper(I) ions forms a film comprising insoluble copper(I)-based organometallics that precipitate on the surface of the copper or copper alloy surface. This precipitate is also thought to be another mechanism whereby heterocycles form a protective organic film on the surface of the copper or copper alloy. Aromatic heterocycles comprising nitrogen suitable for the surface treatment compositions of the present invention comprise nitrogen in a 5-membered ring (azoles). The 5-membered can be fused to another 5-membered or 6-membered aromatic ring, which can also be a heterocycle comprising a nitrogen atom. Further, the aromatic heterocycle can comprise one or more nitrogen atoms, and typically, the aromatic heterocycle comprises between one and four nitrogen atoms. Azoles can have the following structure (IV):

Structure (IV)

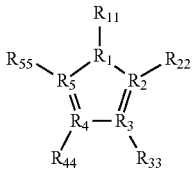

wherein $R_1$, $R_2$, $R_3$, $R_4$, and $R_5$ is an atom selected from the group consisting of carbon and nitrogen wherein between one and four of the $R_1$, $R_2$, $R_3$, $R_4$, and $R_5$ groups are nitrogen and between one and four of the $R_1$, $R_2$, $R_3$, $R_4$, and $R_5$ groups are carbon; and $R_{11}$, $R_{22}$, $R_{33}$, $R_{44}$, and $R_{55}$ are each independently selected from the group consisting of hydrogen, carbon, sulfur, oxygen, and nitrogen.

Any one or more of $R_{11}$, $R_{22}$, $R_{33}$, $R_{44}$, and $R_{55}$ of structure (III) may be carbon wherein the carbon is part of an aliphatic group having between one carbon atom and 24 carbon atoms or part of an aryl group having between five carbon atoms and fourteen carbon atoms. The aliphatic group and the aryl group may be substituted or unsubstituted. The aliphatic group may be branched-chained or straight-chained. Unless otherwise indicated, a substituted aliphatic group or substituted aryl group is substituted with at least one atom other than carbon, including moieties in which a carbon chain atom is substituted with a hetero atom such as nitrogen, oxygen, silicon, phosphorous, boron, sulfur, or a halogen atom. The aliphatic group or aryl may be substituted with one or more of the following substituents: halogen, heterocyclo, alkoxy, alkenoxy, alkynoxy, aryloxy, hydroxy, protected hydroxy, hydroxycarbonyl, keto, acyl, acyloxy, nitro, amino, amido, nitro, phosphono, cyano, thiol, ketals, acetals, esters, and ethers.

In structure (IV), any pair of consecutive $R_{11}$, $R_{22}$, $R_{33}$, $R_{44}$, and $R_{55}$ (e.g., $R_{11}$ and $R_{22}$ or $R_{22}$ and $R_{33}$) can together with the carbon or nitrogen atoms to which they are bonded form a substituted or unsubstituted cycloalkyl or substituted or unsubstituted aryl group with the corresponding pair of consecutive $R_1$, $R_2$, $R_3$, $R_4$, and $R_5$ (e.g., $R_{11}$ and $R_{22}$ form a ring with $R_1$ and $R_2$) such that the ring defined by the $R_1$, $R_2$, $R_3$, $R_4$, and $R_5$ groups is fused to another ring. This ring can comprise between one or two nitrogen atoms. Preferably, the consecutive $R_{11}$, $R_{22}$, $R_{33}$, $R_{44}$, and $R_{55}$ and the corresponding consecutive $R_1$, $R_2$, $R_3$, $R_4$, and $R_5$ form a six-membered aromatic ring.

Preferably, the azole of structure (IV) is not substituted. Exemplary azoles are shown in Table I. Preferred azoles from among those listed in Table I include imidazole (1,3-diazole), benzimidazole (1,3-benzodiazole), 1H-benzotriazole, and 2H-benzotriazole.

TABLE I

| Azoles | |
|---|---|
| Name | Structure |
| Pyrrole (1H-azole) | 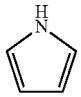 |
| Imidazole (1,3-diazole) | 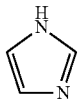 |

TABLE I-continued

| Azoles | |
|---|---|
| Name | Structure |
| Pyrazole (1,2-diazole) | |
| 1,2,3-triazole | |
| 1,2,4-triazole | |
| Tetrazole | |
| Isoindole | |
| Indole (1H-Benzo[b]pyrrole) | |
| Benzimidazole (1,3-benzodiazole) | |
| Indazole (1,2-benzodiazole) | |
| 1H-Benzotriazole | |
| 2H-Benzotriazole | |
| Imidazo[4,5-b]pyridine | |
| Purine (7H-Imidazo(4,5-d)pyrimidine) | |
| Pyrazolo[3,4-d]pyrimidine | |

TABLE I-continued

| Azoles | |
|---|---|
| Name | Structure |
| Triazolo[4,5-d]pyrimidine | |

Any one of the above-described nitrogen-containing organic compounds, i.e., primary amine, secondary amine, tertiary amine, and aromatic heterocycle comprising nitrogen, may be used singly or in combination in the surface treating composition of the present invention. The nitrogen-containing organic compound may be added to the surface treating compositions of the present invention at a concentration between about 0.01% by weight (about 0.1 g/L) and about 10% by weight (about 100 g/L), preferably between about 0.1% by weight (about 1.0 g/L) and about 1.0% by weight (about 10 g/L). The nitrogen-containing organic compound may be added to the composition in at least about 0.01% by weight (about 0.1 g/L) to achieve sufficient coverage and protection of the copper substrate. The maximum concentration of about 10% by weight (about 100 g/L) is an estimate based on the compound's solubility and therefore may be higher or lower than the stated amount depending upon the identity of the compound. In a preferred composition, the nitrogen-containing organic compound is a aromatic heterocycle comprising nitrogen, particularly, benzotriazole added in a concentration between about 0.1% by weight (about 1 g/L) and about 1% by weight (about 10 g/L), for example, about 0.3% by weight (about 3 g/L).

The above-described phosphorus oxide compounds and nitrogen-containing organic compounds are dissolved in a solvent. Preferably, the solvent is characterized by a relatively high boiling point. High boiling solvents are preferred due to safety considerations. Moreover, high boiling solvents have been discovered to increase the stability of the surface treating compositions of the present invention. Even more preferably, the solvent is characterized by both a high boiling point and miscibility with water. It has been discovered that miscibility with water improves the appearance of the final coated product, particularly since, in preferred embodiments, the substrate is rinsed after exposure to the surface treating compositions of the present invention. Applicable solvents include high boiling point alcohols, having a boiling point preferably at least about 90° C., and preferably at least about 110° C., even more preferably at least about 150° C. Exemplary high boiling point alcohols for use in the compositions of the present invention include those having four or more carbon atoms, such as n-propanol, isopropanol, 1-butanol, 2-butanol, tert-butanol, iso-butanol, 1-pentanol, 2-pentanol, other pentanols, 1-hexanol, other hexanols, heptanols, 1-octanol, 2-octanol, and other octanols, 1-decanol and other decanols, phenol, benzyl alcohol, furfuryl alcohol, tetrahydrofurfuryl alcohol, 2-methoxyethanol, ethylene glycol, glycerol, diethylene glycol, triethylene glycol, diethylene glycol monomethyl ether, 2-(cyclohexyloxy)ethanol, 1-(2-furyl)ethanol, and 2-ethoxyethanol. In a preferred embodiment, the solvent is 2-ethoxyethanol.

The copper or copper alloy surface may be treated with the surface treating composition of the present invention by dipping, flooding, or spray immersion, provided that the application method sufficiently wets the copper-based surface for a sufficient time for the organic additives to form films of self-assembled monolayers on the copper surface and exposed areas of the substrate.

The duration of exposure is not narrowly critical to the efficacy of the invention and may depend in part on engineering aspects of the process. Typical exposure times may be as little as about 1 second to as long as about 10 minutes, more typically between about 5 seconds and about 600 seconds. In practice, the exposure time may be between about 30 seconds and about 300 seconds, typically between about 60 seconds and about 180 seconds, such as about 180 seconds. In view of these relatively short exposure times, the method of the present invention achieves rapid substrate coating. The temperature of the surface treating composition may vary between about 20° C. up to about 75° C., typically between about 25° C. and about 55° C., such as between about 25° C. and about 45° C. Exposure to the surface treating composition may be enhanced with scrubbing, brushing, squeegeeing, agitation, and stirring. In particular, agitation has been shown to be an effective means of enhancing the ability of the composition to apply a protective organic coating to the substrate. The agitation may be vigorous. After exposing the substrate to the surface treating composition, the substrate may be rinsed, typically with deionized water for between about 10 seconds to about 2 minutes and hot dried, such as with a blow-dryer.

The following examples further exemplify the surface treating compositions of the present invention.

EXAMPLES

Example 1. Surface Treating Composition of the Invention

A surface treating composition of the present invention was prepared having the following components:

N-octadecyl phosphonic acid (10 g)
Benzotriazole (3.0 g)
2-Ethoxyethanol (1000 mL)

Example 2. Treating Bronze Surface Coating with Solution of Example 1

A steel coupon was coated with a tin-copper alloy comprising 45% by weight tin and 55% by weight copper using Bronzex® WMR (Enthone Inc., West Haven, Conn.) and was additionally treated with the surface treating composition of Example 1 according to the following protocol:

1. Hot degrease (5% solution, ENPREP® FECU) for 5 minutes at 55° C.
2. Rinse with distilled water.
3. Cathodic degrease (8% solution, ENPREP® FECU) for 3 minutes at 55° C. at a current density of 5 A/dm$^2$.
4. Rinse with distilled water.
5. Activation using ACTANE® SE at room temperature, according to instructions provided by Enthone Inc.
6. Rinse with distilled water.
7. Deposit bronze surface coating using Bronzex® WMR for 9 minutes at 25° C. at a current density of 1 A/dm$^2$ and rack agitation of 2.5 m/min. The bronze surface coating comprises 55% by weight copper and 45% by weight tin.
8. Rinse with circulation water.
9. Activation using ACTANE® SE at room temperature, according to instructions provided by Enthone Inc.
10. Rinse with circulation water.
11. Apply protective organic coating to bronze surface coating using surface treating composition of Example 1 by dipping the bronze surface coating in the composition for 3 minutes at 40° C. with stirring.
12. Hot drying the surface with a blow dryer.

Example 3. Treating Bronze Surface Coating with Solution of Example 1

A steel coupon was coated with a tin-copper alloy having 45% by weight tin and 55% by weight copper using Bronzex® WMR (Enthone Inc., West Haven, Conn.) and was additionally treated with the surface treating composition of Example 1 according to the following protocol:

1. Hot degrease (5% solution, ENPREP® FECU) for 5 minutes at 55° C.
2. Rinse with distilled water.
3. Cathodic degrease (8% solution, ENPREP® FECU) for 3 minutes at 55° C. at a current density of 5 A/dm$^2$.
4. Rinse with distilled water.
5. Activation using ACTANE® SE at room temperature, according to instructions provided by Enthone Inc.
6. Rinse with distilled water.
7. Deposit bronze surface coating using Bronzex® WMR for 9 minutes at 25° C. at a current density of 1 A/dm$^2$ and rack agitation of 2.5 m/min. The bronze surface coating comprises 55% by weight copper and 45% by weight tin.
8. Rinse with circulation water.
9. Activation using ACTANE® SE at room temperature, according to instructions provided by Enthone Inc.
10. Rinse with circulation water.
11. Apply protective organic coating to bronze surface coating using surface treating composition of Example 1 by dipping the bronze surface coating in the composition for 3 minutes at 40° C. with stirring.
12. Rinse with distilled water for 30 seconds at 40° C.
13. Hot drying the surface with a blow dryer.

Example 4. Treating Bronze Surface Coating with Solution of Example 1

A steel coupon was coated with a tin-copper alloy having 45% by weight tin and 55% by weight copper using Bronzex® WMR (Enthone Inc., West Haven, Conn.) and was additionally treated with the surface treating composition of Example 1 according to the following protocol:

1. Hot degrease (5% solution, ENPREP® FECU) for 5 minutes at 55° C.
2. Rinse with distilled water.
3. Cathodic degrease (8% solution, ENPREP® FECU) for 3 minutes at 55° C. at a current density of 5 A/dm$^2$.
4. Rinse with distilled water.
5. Activation using ACTANE® SE at room temperature, according to instructions provided by Enthone Inc.
6. Rinse with distilled water.
7. Deposit bronze surface coating using Bronzex® WMR for 9 minutes at 25° C. at a current density of 1 A/dm$^2$ and rack agitation of 2.5 m/min. The bronze surface coating comprises 55% by weight copper and 45% by weight tin.
8. Rinse with circulation water.
9. Activation using ACTANE® SE at room temperature, according to instructions provided by Enthone Inc.
10. Rinse with circulation water.
11. Apply protective organic coating to bronze surface coating using surface treating composition of Example 1 by dipping the bronze surface coating in the composition for 3 minutes at 40° C. with stirring.

12. Rinse with distilled water for 30 seconds at 40° C.
13. Hot drying in an oven for 25 minutes at 80° C.

Example 5. Treating Bronze Surface Coating with Solution of Example 1

A steel coupon was coated with a tin-copper alloy having 45% by weight tin and 55% by weight copper using Bronzex® WMR (Enthone Inc., West Haven, Conn.) and was additionally treated with the surface treating composition of Example 1 according to the following protocol:

1. Hot degrease (5% solution, ENPREP® FECU) for 5 minutes at 55° C.
2. Rinse with distilled water.
3. Cathodic degrease (8% solution, ENPREP® FECU) for 3 minutes at 55° C. at a current density of 5 A/dm$^2$.
4. Rinse with distilled water.
5. Activation using ACTANE® SE at room temperature, according to instructions provided by Enthone Inc.
6. Rinse with distilled water.
7. Deposit bronze surface coating using Bronzex® WMR for 9 minutes at 25° C. at a current density of 1 A/dm$^2$ and rack agitation of 2.5 m/min. The bronze surface coating comprises 55% by weight copper and 45% by weight tin.
8. Rinse with circulation water.
9. Activation using ACTANE® SE at room temperature, according to instructions provided by Enthone Inc.
10. Rinse with circulation water.
11. Apply protective organic coating to bronze surface coating using surface treating composition of Example 2 by dipping the bronze surface coating in the composition for 3 minutes at 40° C. with stirring.
12. Hot drying the surface with a blow dryer.

Example 6. Treating Bronze Surface Coating with Solution of Example 1

A steel coupon was coated with a tin-copper alloy having 45% by weight tin and 55% by weight copper using Bronzex® WMR (Enthone Inc., West Haven, Conn.) and was additionally treated with the surface treating composition of Example 1 according to the following protocol:

1. Hot degrease (5% solution, ENPREP® FECU) for 5 minutes at 55° C.
2. Rinse with distilled water.
3. Cathodic degrease (8% solution, ENPREP® FECU) for 3 minutes at 55° C. at a current density of 5 A/dm$^2$.
4. Rinse with distilled water.
5. Activation using ACTANE® SE at room temperature, according to instructions provided by Enthone Inc.
6. Rinse with distilled water.
7. Deposit bronze surface coating using Bronzex® WMR for 9 minutes at 25° C. at a current density of 1 A/dm$^2$ and rack agitation of 2.5 m/min. The bronze surface coating comprises 55% by weight copper and 45% by weight tin.
8. Rinse with circulation water.
9. Activation using ACTANE® SE at room temperature, according to instructions provided by Enthone Inc.
10. Rinse with circulation water.
11. Apply protective organic coating to bronze surface coating using surface treating composition of Example 2 by dipping the bronze surface coating in the composition for 3 minutes at 40° C. with stirring.
12. Rinse with distilled water for 30 seconds at 40° C.
13. Hot drying the surface with a blow dryer.

Example 7. Treating Bronze Surface Coating with Solution of Example 1

A steel coupon was coated with a tin-copper alloy having 45% by weight tin and 55% by weight copper using Bronzex® WMR (Enthone Inc., West Haven, Conn.) and was additionally treated with the surface treating composition of Example 1 according to the following protocol:

1. Hot degrease (5% solution, ENPREP® FECU) for 5 minutes at 55° C.
2. Rinse with distilled water.
3. Cathodic degrease (8% solution, ENPREP® FECU) for 3 minutes at 55° C. at a current density of 5 A/dm$^2$.
4. Rinse with distilled water.
5. Activation using ACTANE® SE at room temperature, according to instructions provided by Enthone Inc.
6. Rinse with distilled water.
7. Deposit bronze surface coating using Bronzex® WMR for 9 minutes at 25° C. at a current density of 1 A/dm$^2$ and rack agitation of 2.5 m/min. The bronze surface coating comprises 55% by weight copper and 45% by weight tin.
8. Rinse with circulation water.
9. Activation using ACTANE® SE at room temperature, according to instructions provided by Enthone Inc.
10. Rinse with circulation water.
11. Apply protective organic coating to bronze surface coating using surface treating composition of Example 2 by dipping the bronze surface coating in the composition for 3 minutes at 40° C. with stirring.
12. Rinse with distilled water for 30 seconds at 40° C.
13. Hot drying in an oven for 25 minutes at 80° C.

Comparative Example 8. Untreated Bronze Surface Coating

A steel coupon was coated with a tin-copper alloy having 45% by weight tin and 55% by weight copper using Bronzex® WMR (Enthone Inc., West Haven, Conn.). The bronze surface coating was not treated with a surface treating composition. Bronze surface coating occurred as follows:

1. Hot degrease (5% solution, ENPREP® FECU) for 5 minutes at 55° C.
2. Rinse with distilled water.
3. Cathodic degrease (8% solution, ENPREP® FECU) for 3 minutes at 55° C. at a current density of 5 A/dm$^2$.
4. Rinse with distilled water.
5. Activation using ACTANE® SE at room temperature, according to instructions provided by Enthone Inc.
6. Rinse with distilled water.
7. Deposit bronze surface coating using Bronzex® WMR for 9 minutes at 25° C. at a current density of 1 A/dm$^2$ and rack agitation of 2.5 m/min. The bronze surface coating comprises 55% by weight copper and 45% by weight tin.
8. Hot drying the surface with a blow dryer.

Example 9. Humidity Testing of Treated and Untreated Bronze Surface Coatings

The bronze surface coated and treated coupons of Examples 2-7 and the bronze surface coated and untreated coupon of Comparative Example 8 were subjected to humidity testing. Humidity testing involved exposing the bronze surface coated coupons to an atmosphere comprising 85% humidity at a temperature of 85° C. for 48 hours. A coupon is considered to have passed this test if discoloration and corrosion spots are not apparent after the 48 hour exposure period.

Figure 1G:
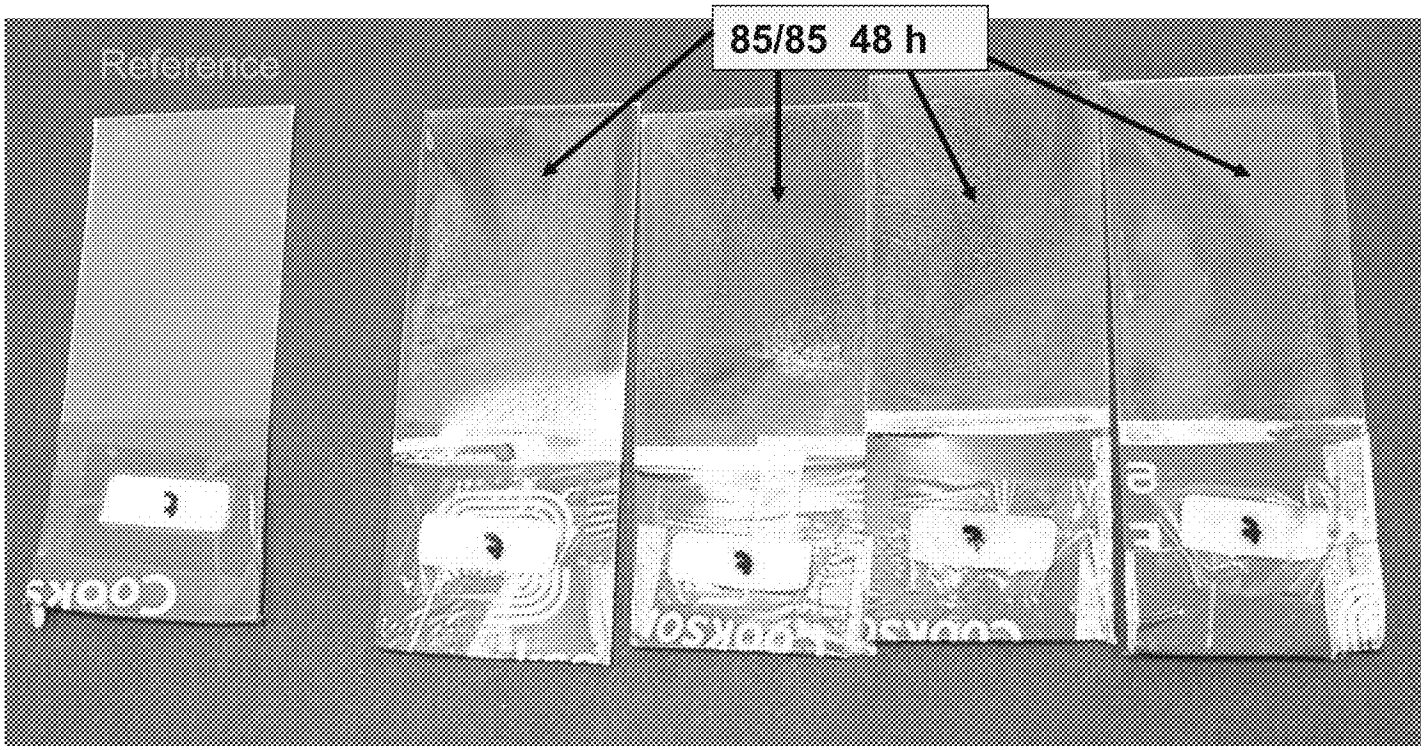

Seven sets of five coupons were bronze surface coated and treated according to the protocols described in Examples 2-7 and Comparative Example 8. One coupon (i.e., that reference coupon) from each of the seven sets was not subjected to humidity testing, while four coupons from each of the seven sets were exposed to an atmosphere comprising 85% humidity at a temperature of 85° C. for 48 hours. After 48 hours exposure, the coupons were inspected visually for discoloration and corrosion spots. FIGS. 1A through 1F are photographs of the reference coupons and coupons subjected to humidity testing that were treated according to the methods described in Examples 2-7, respectively. FIG. 1G is a photograph of the reference coupon and coupons subjected to humidity testing that were merely coated with a bronze layer according to the method described in Comparative Example 8.

It is apparent that all of the bronze surface coated and treated coupons of Examples 2-6 while two of the coupons of Example 7 passed the test. That is, there was no apparent corrosion or discoloration. All four of the bronze surface coated coupons of Comparative Example 8 failed the since the coupons exhibited severe corrosion.

Example 10. Artificial Sweat Testing of Treated and Untreated Bronze Surface Coatings The bronze surface coated and treated coupons of Examples 2-7 and the bronze surface coated and untreated coupons of Comparative Example 8 were subjected to artificial sweat testing. Artificial sweat testing involved dipping the coupons in a solution comprising the following components:

Sodium chloride (20 g/L)
Ammonium chloride (17.5 g/L)
Urea (5 g/L)
Acetic acid (2.5 g/L)
Lactic acid (15 g/L).

The pH of the solution is about 4.7, and the solution temperature is about 40° C.

Figure 2A:
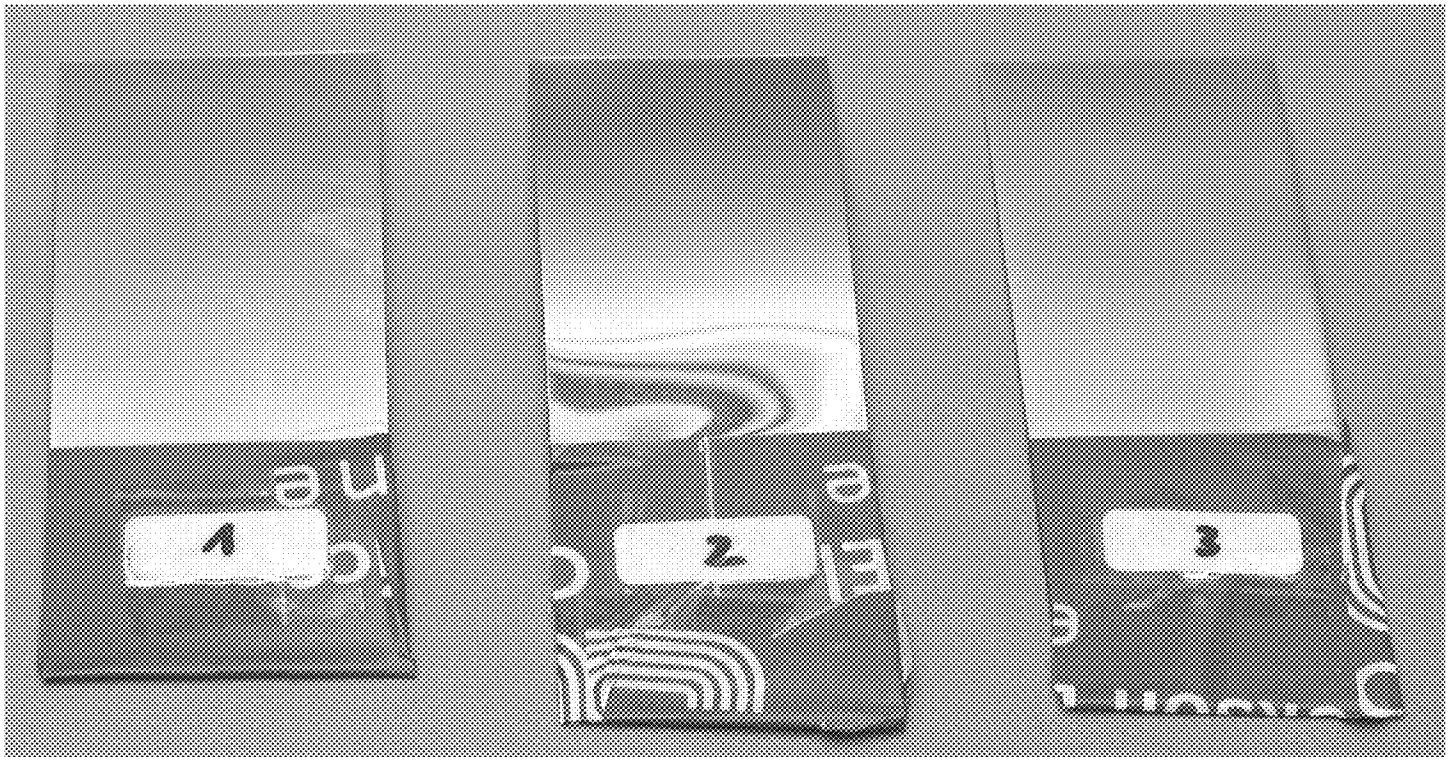
FIGS. 2A through 2C are photographs of bronze coated coupons subjected to artificial sweat testing according to the method of Example 10.
Figure 2B:
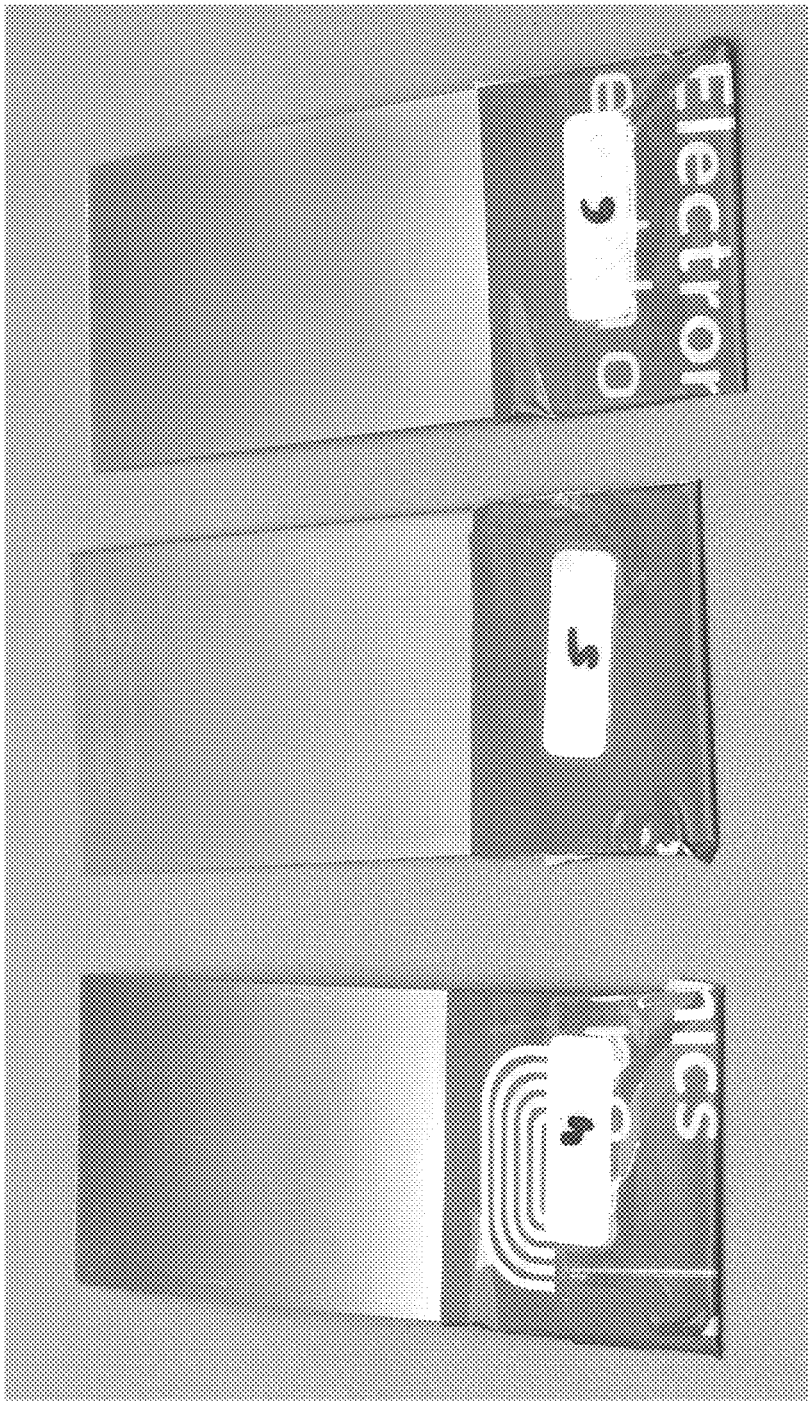
Figure 2C:
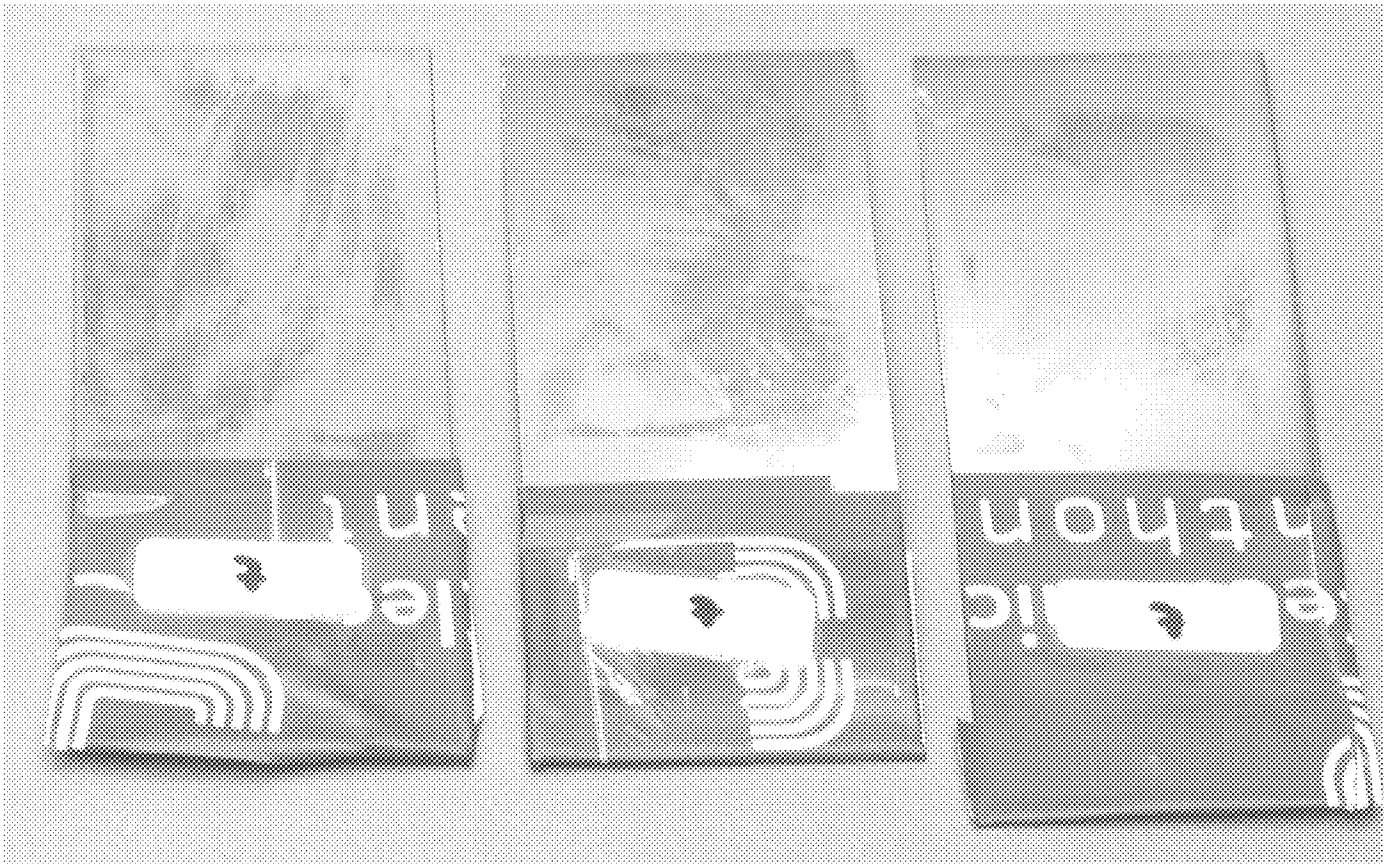

A coupon is considered to have passed this test if there are no apparent discoloration or corrosion spots after dipping for at least 24 hours. Six coupons were bronze surface coated and treated according to the protocols described in Examples 2-7. Three coupons were bronze coated according to the protocol described in Comparative Example 8. All nine coupons were dipped in the artificial sweat for 24 hours. After 24 hours, the six coupons coated with bronze and treated according to the methods described in Examples 2-7 exhibited no apparent discoloration or corrosion spots. See FIGS. 2A and 2B, which are photographs of these coupons. The coupon labeled 1 was bronze coated and treated according to the method described in Example 2. The coupon labeled 2 was bronze coated and treated according to the method described in Example 3. The coupon labeled 3 was bronze coated and treated according to the method described in Example 4. The coupon labeled 4 was bronze coated and treated according to the method described in Example 5. The coupon labeled 5 was bronze coated and treated according to the method described in Example 6. The coupon labeled 6 was bronze coated and treated according to the method described in Example 7. All three untreated parts of Comparative Example 8 exhibited substantial discoloration. See FIG. 2C, which is a photograph of these coupons.

Figure 3A:
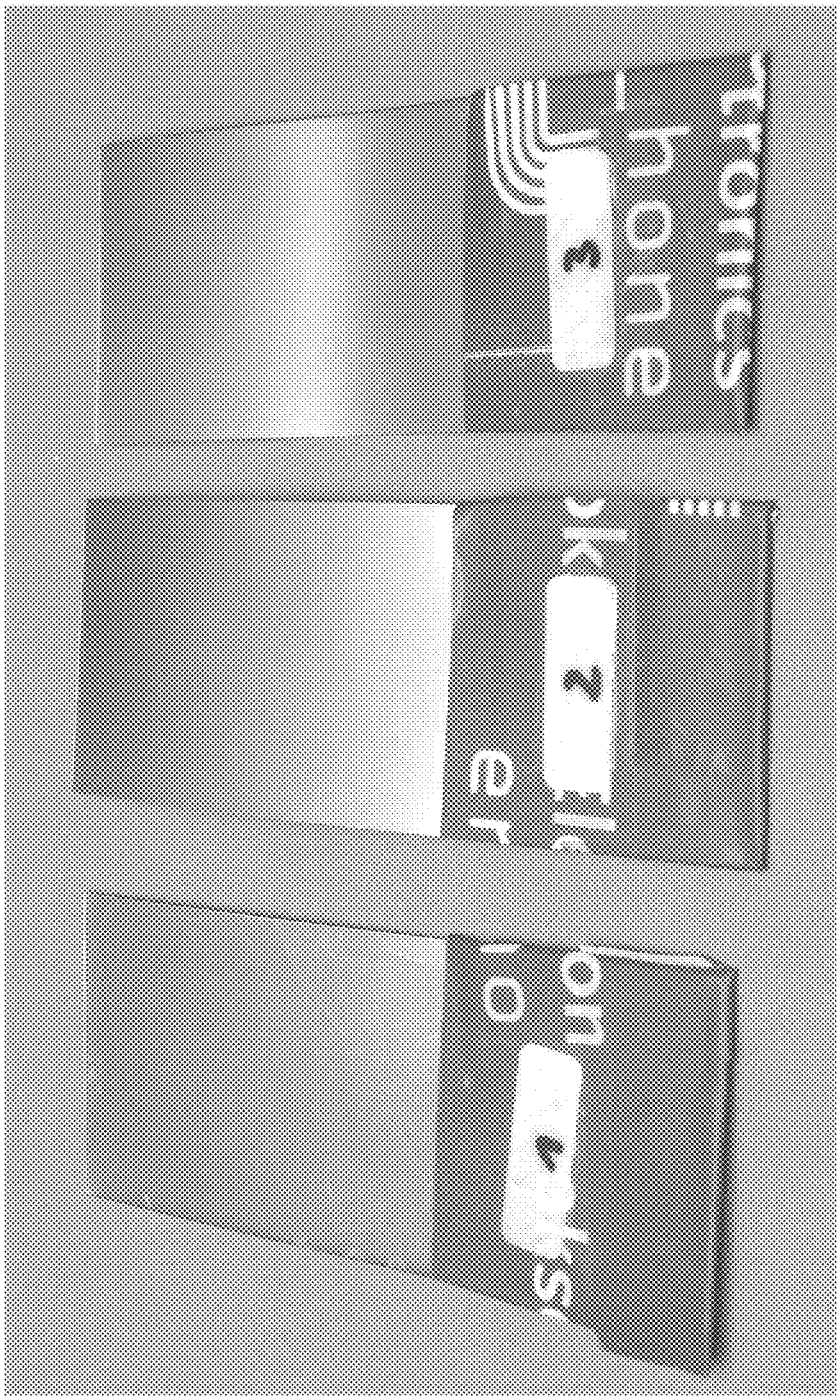
FIGS. 3A and 3B are photographs of bronze coated coupons subjected to artificial sweat testing according to the method of Example 10.
Figure 3B:
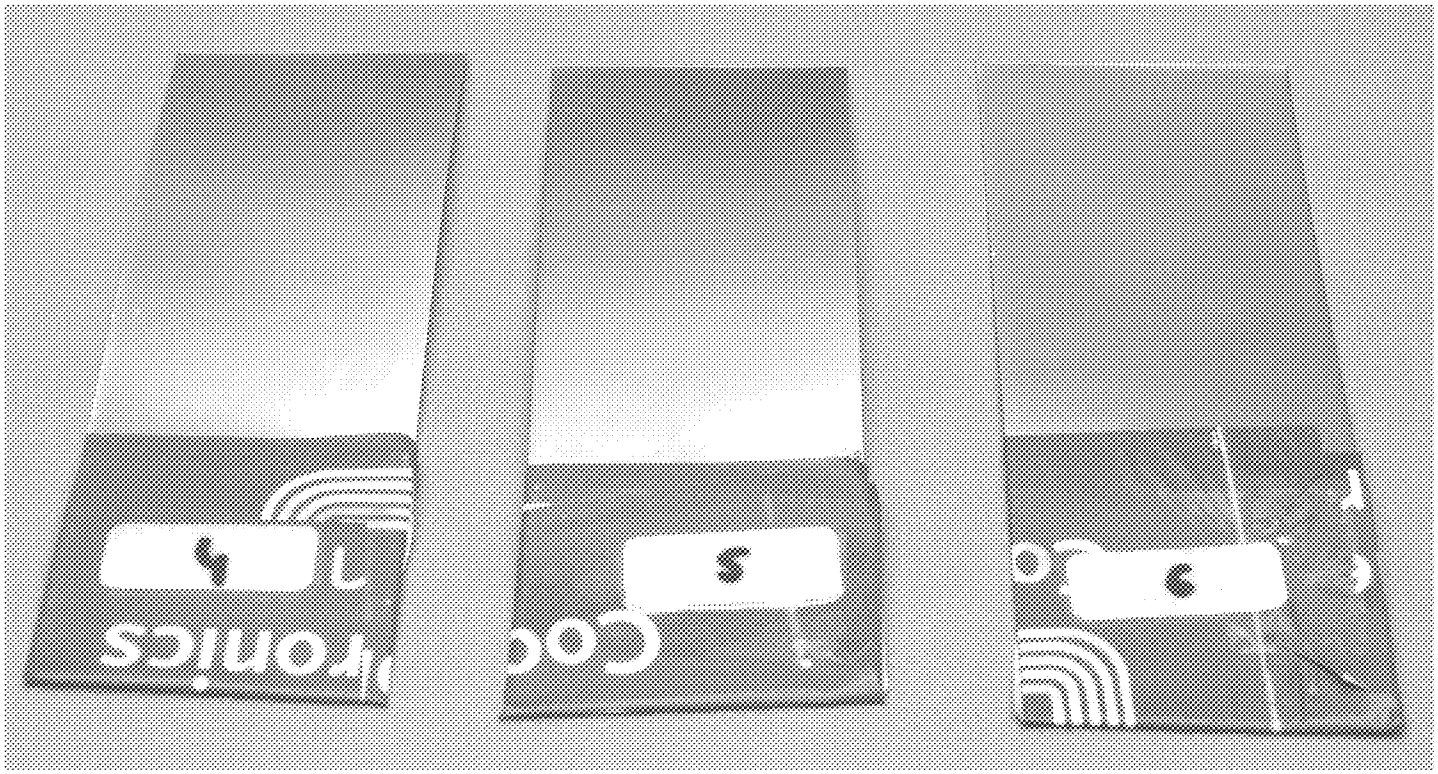

The test was repeated on the coupons labeled 1 through 6 that were bronze coated and treated according to the methods described in Examples 2-7, respectively. The duration was extended to 48 hours. Again, none of the treated coupons of Examples 2-7 exhibited apparent discoloration or corrosion spots even after 48 hours of dipping in artificial sweat. See FIGS. 3A and 3B, which are photographs of these coupons after 48 hours exposure to artificial sweat.

Example 11. Neutral Salt Spray Testing of Treated and Untreated Bronze Surface Coatings The bronze surface coated and treated coupons of Examples 2-7 and the bronze surface coated and untreated coupon of Comparative Example 8 were subjected to neutral salt spray testing according to DIN-EN-ISO 9227.

Figure 4A:
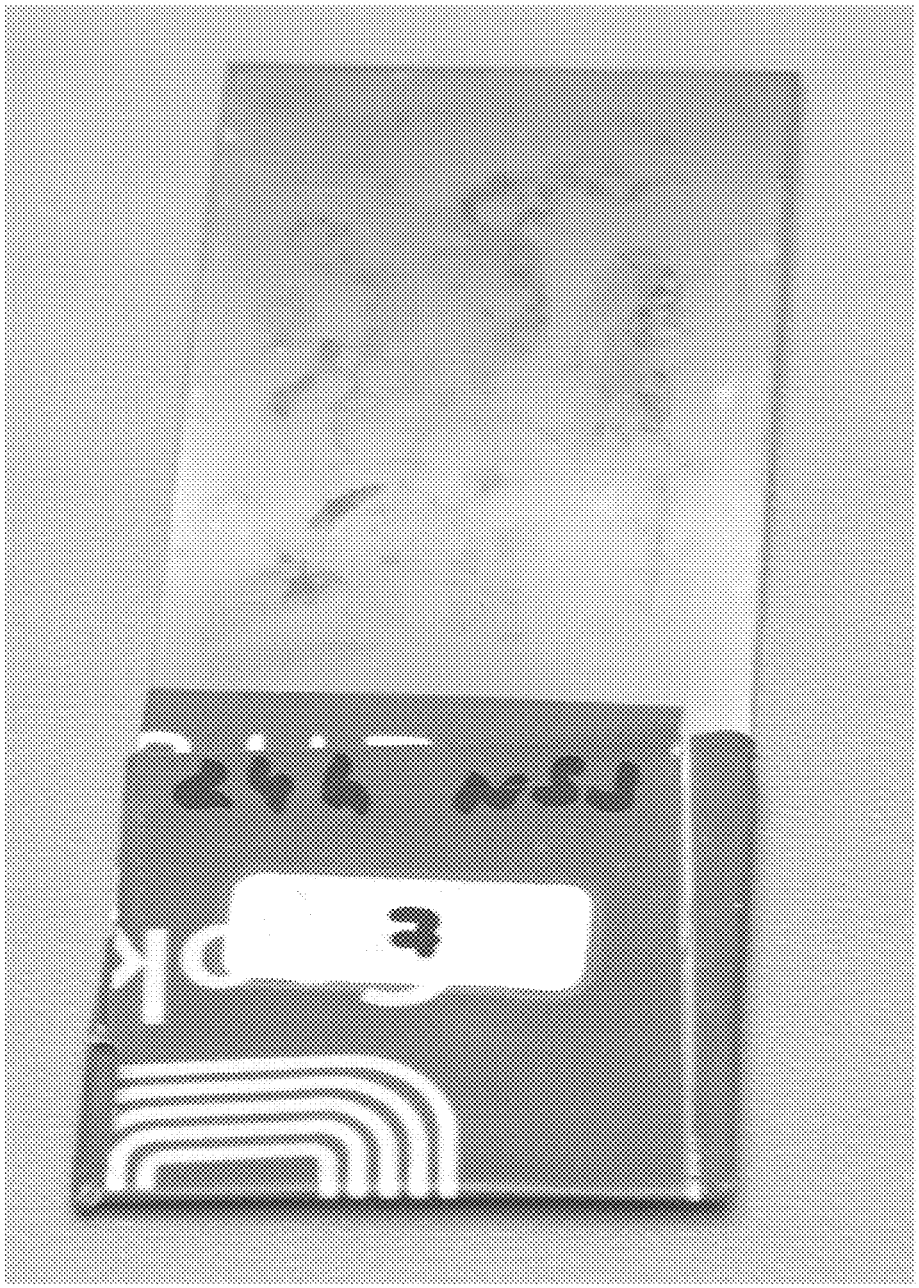
FIGS. 4A through 4H are photographs of bronze coated coupons subjected to neutral salt spray testing according to the method of Example 11.
Figure 4B:
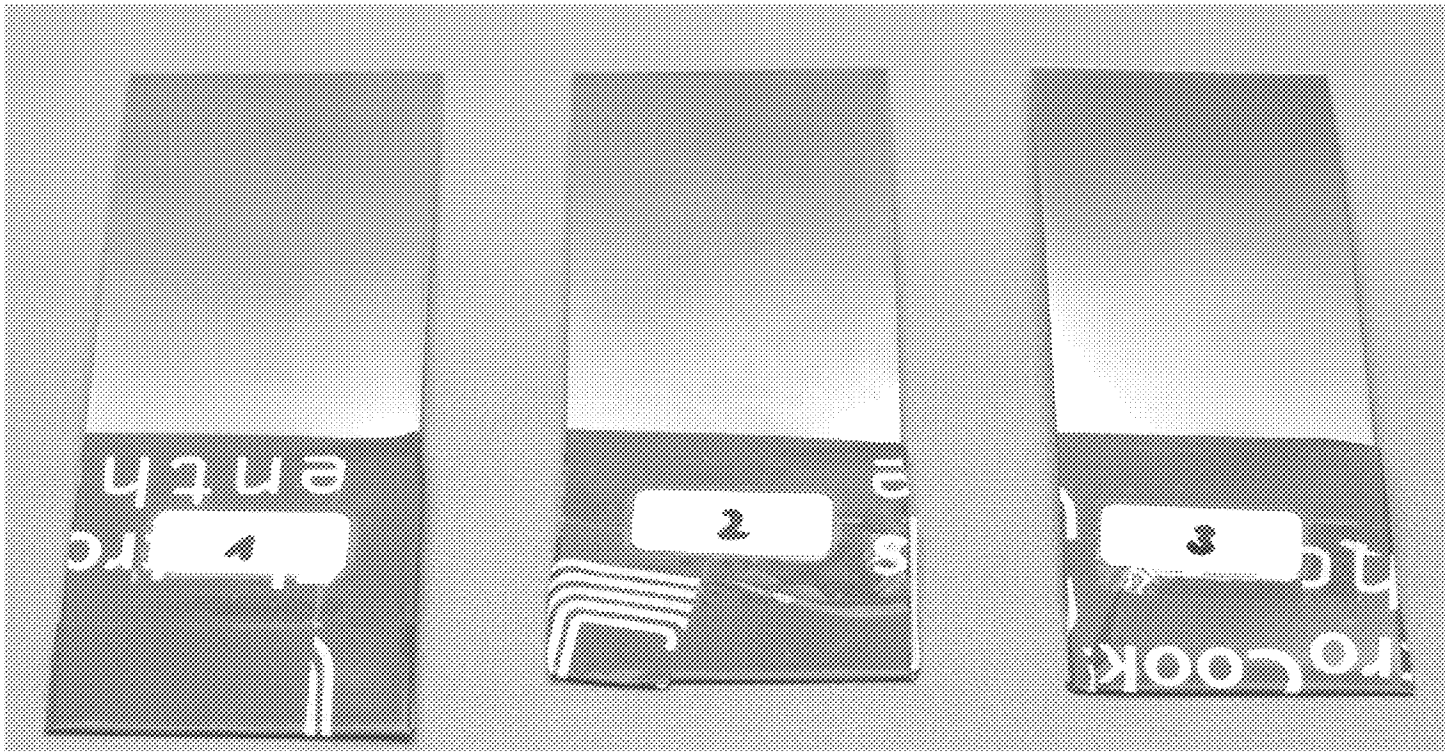
Figure 4C:
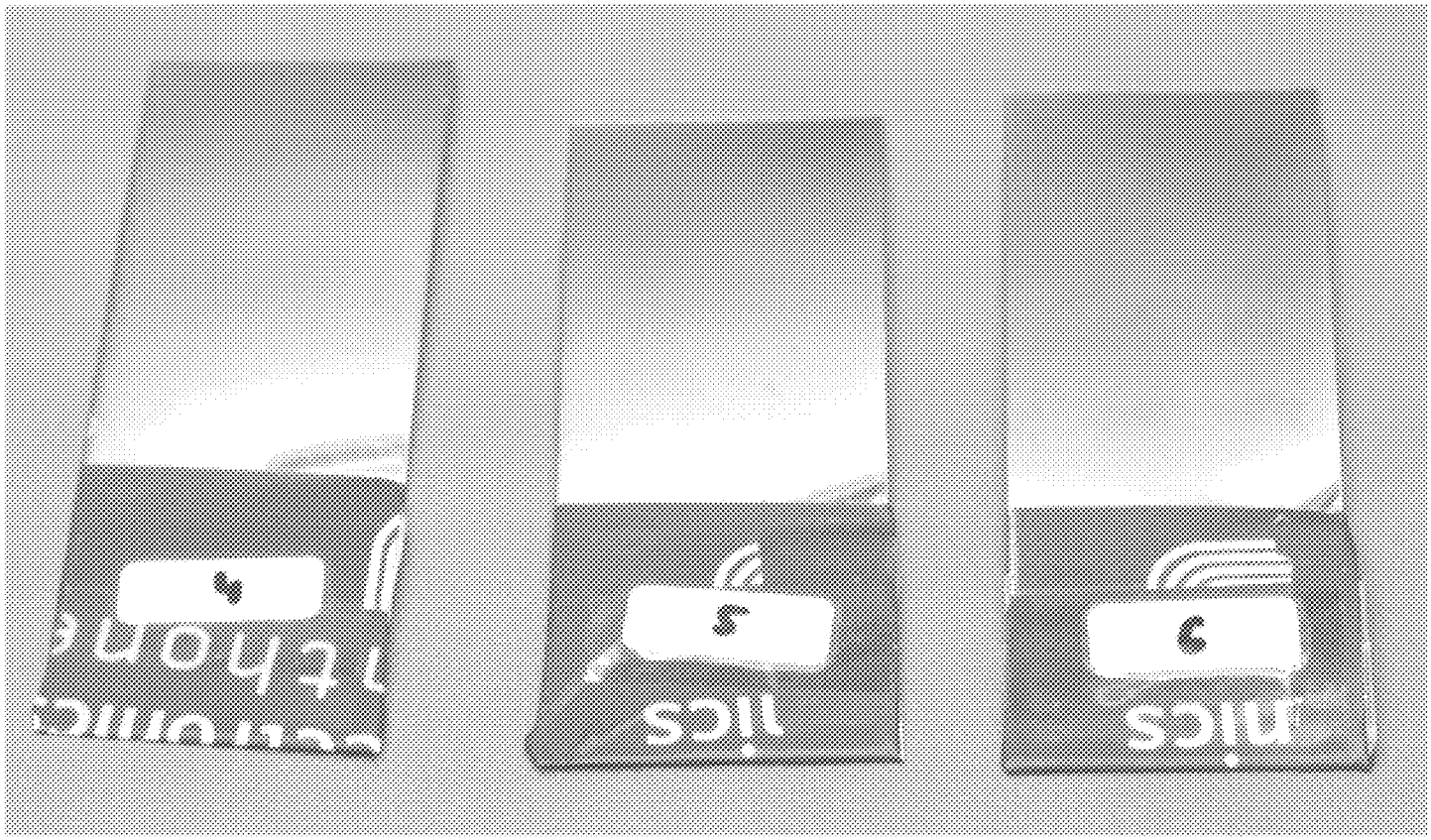
Figure 4D:
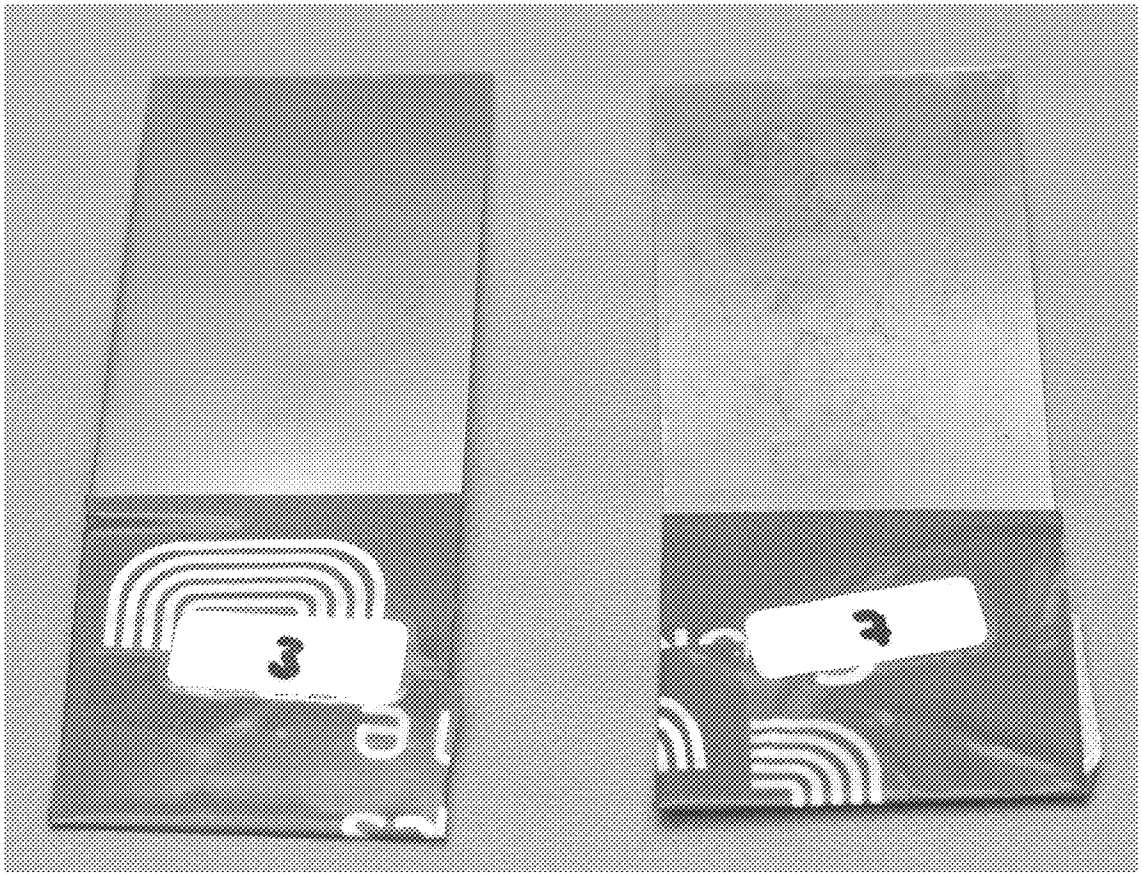
Figure 4E:
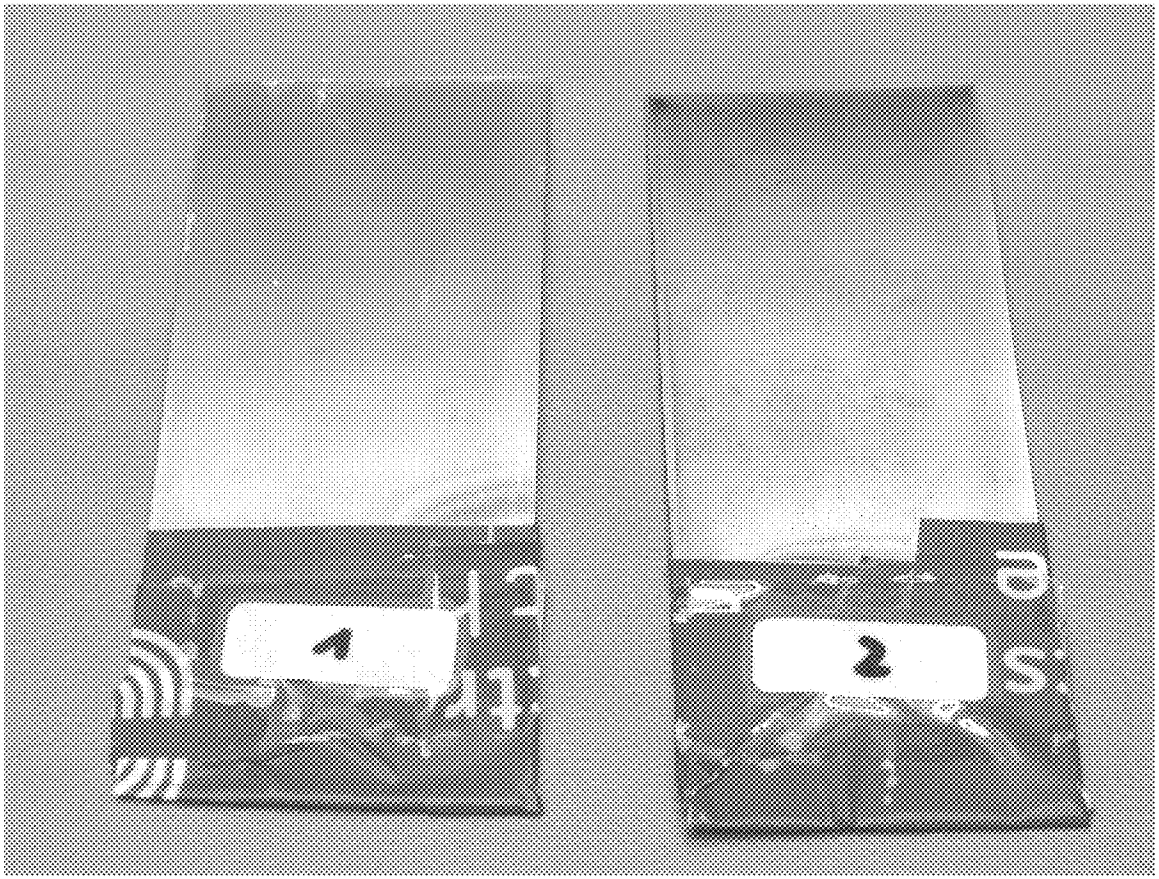
Figure 4F:
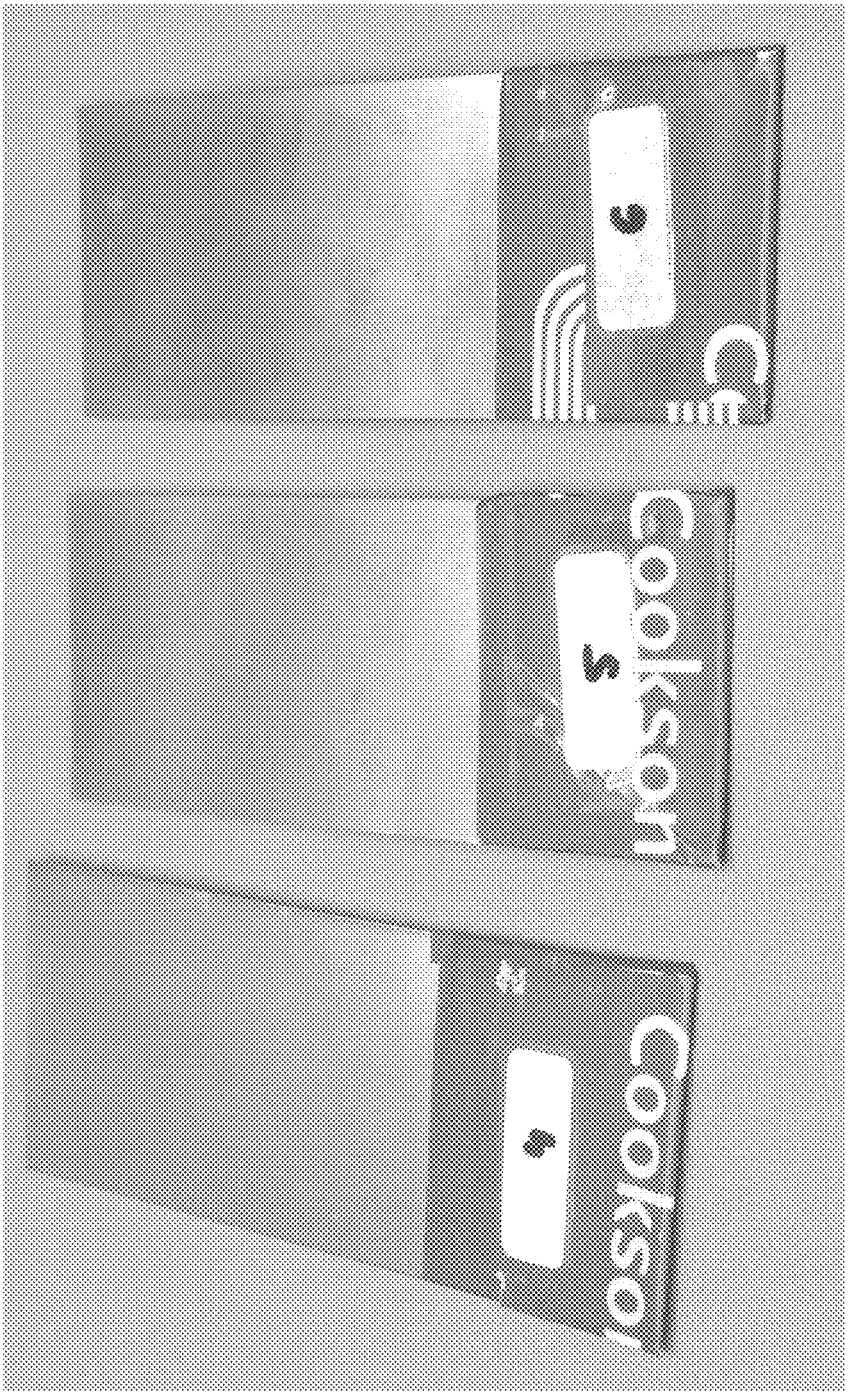
Figure 4G:
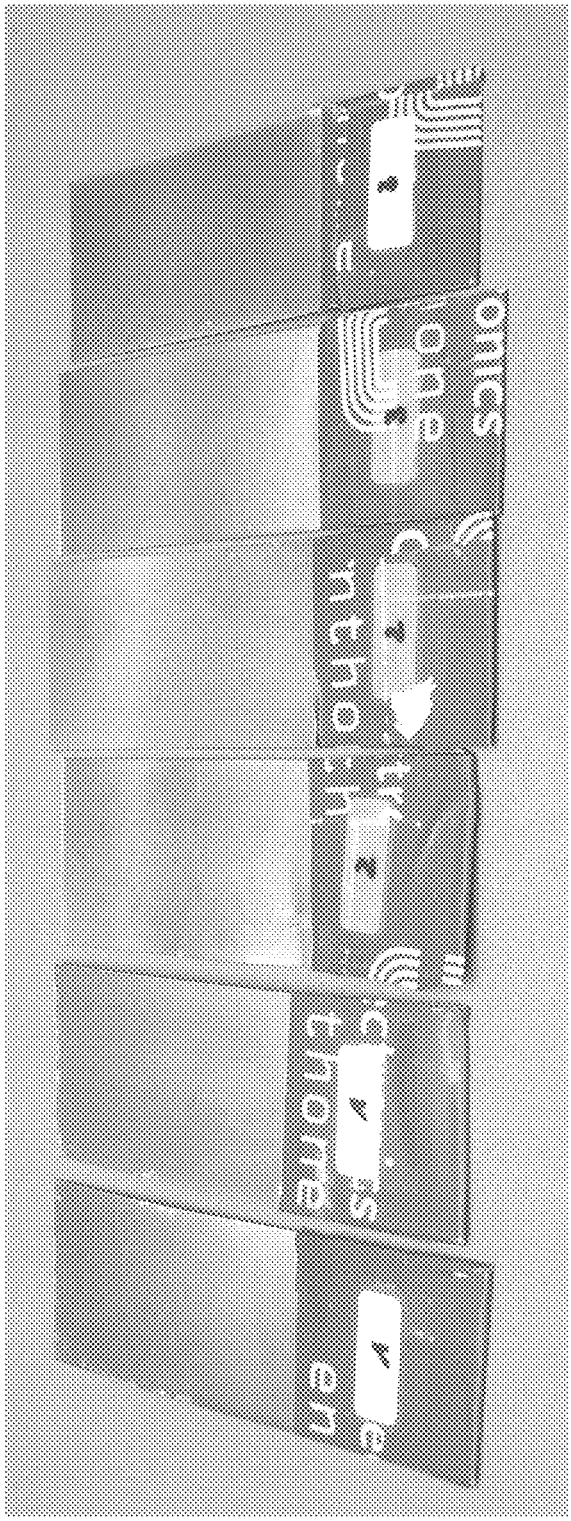
Figure 4H:
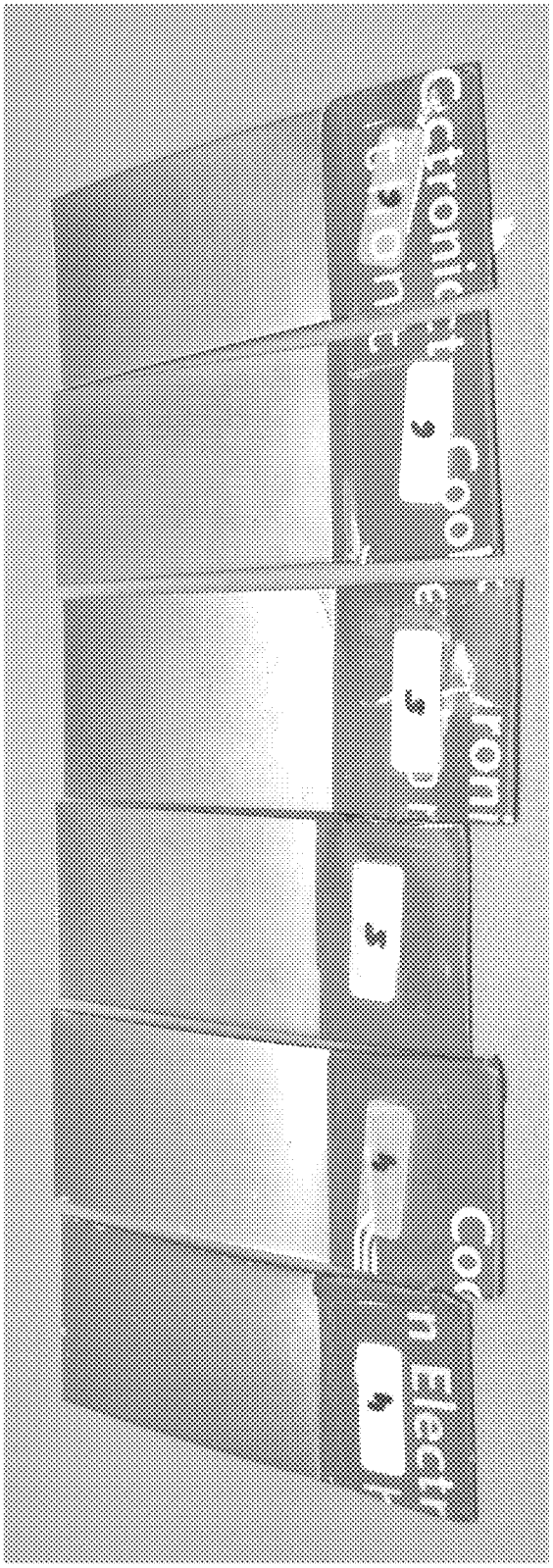

Neutral salt spray testing involved spraying the bronze surface coated coupons with a solution comprising sodium chloride (50±5 g/L) at a temperature of about 35° C. The pH is nearly neutral and may vary from about 6.5 to about 7.2. The coated part was sprayed until discoloration and corrosion spots became visually apparent. For reference, the untreated part of Comparative Example 8 exhibited discoloration in as little as 24 hours of neutral salt spraying. See FIG. 4A. In contrast, the treated parts of Examples 2-7 exhibited no apparent discoloration or corrosion spots after 48 hours of neutral salt spraying. See FIGS. 4B and 4C, which are photographs of coupons labeled 1-6, corresponding to coupons bronze coated and treated according to the methods described in Examples 2-7, respectively. After 72 hours of spraying, the coupon labeled 3 (corresponding to the method of Example 4) exhibited visible spots. See FIG. 4D. The coupons labeled 1, 2, 4, 5 and 6 (corresponding to the methods of Examples 2, 3, and 5-7, respectively) exhibited visible spots only after spraying for 196 hours. See FIGS. 4E and 4F. The coupons that were bronze coated and treated according to the methods described in Examples 2-7 were sprayed for a total of 320 hours. See FIGS. 4F and 4G, which show that even though all treated parts exhibited visible corrosion spots after 320 hours of spraying, none of the treated coupons exhibited the extensive discoloration that became apparent on the untreated coupon of Example 8 after only 24 hours of spraying.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. For example, that the foregoing description and following claims refer to "a" layer means that there can be one or more such layers. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

We claim:

1. A method for enhancing corrosion resistance, wear resistance, and contact resistance of a metal substrate comprising a copper or copper alloy layer on top of a surface of a metal base comprising a metal selected from the group consisting of iron, nickel, tin, zinc, chromium, titanium and precious metals, the method comprising:

exposing the copper or copper alloy layer to a composition comprising a phosphorus oxide compound;

a nitrogen-containing organic compound selected from the group consisting of primary amine, secondary amine, tertiary amine, and combinations thereof; and an alcohol having a boiling point of at least about 110° C.;

wherein the phosphorus oxide compound has the structure (I):

Structure (I)

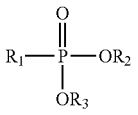

wherein $R_1$ is a hydrocarbyl having between one carbon atom and 24 carbon atoms; and $R_2$ and $R_3$ are each independently or together hydrogen, a charge balancing cation, or a hydrocarbyl having between one carbon atom and four carbon atoms; and wherein the nitrogen-containing organic compound has the following structure (III):

Structure (III)

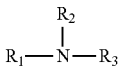

wherein $R_1$, $R_2$, and $R_3$ are each independently hydrogen or a hydrocarbyl having between one carbon atom and about 24 carbon atoms; and at least one of $R_1$, $R_2$, and $R_3$ is a hydrocarbyl having between one carbon atom and about 24 carbon atoms.

2. The method of claim 1 wherein the phosphorus oxide compound is selected from the group consisting of ethylphosphonic acid, n-propylphosphonic acid, isopropylphosphonic acid, n-butylphosphonic acid, tert-butylphosphonic acid, pentylphosphonic acids, hexylphosphonic acids, heptylphosphonic acids, n-octylphosphonic acid, n-decyl phosphonic acid, n-dodecyl phosphonic acid, n-tetradecyl phosphonic acid, n-hexadecyl phosphonic acid, n-octadecyl phosphonic acid, their salts, their esters, and combinations thereof.

3. The method of claim 1 wherein the phosphorus oxide compound is selected from the group consisting of vinylphosphonic acid, allylphosphonic acid, phenyl phosphonic acid, benzyl phosphonic acid, (ortho-tolyl)phosphonic acid, (meta-tolyl)phosphonic acid, (para-tolyl)phosphonic acid, (4-ethylphenyl)phosphonic acid, (2,4-xylyl)phosphonic acid, (3,4-xylyl)phosphonic acid, (2,5-xylyl)phosphonic acid, (3,5-xylyl)phosphonic acid, their salts, their esters, and combinations thereof.

4. The method of claim 1, wherein the nitrogen-containing organic compound is the primary amine selected from the group consisting of aminoethane, 1-aminopropane, 2-aminopropane, 1-aminobutane, 2-aminobutane, 1-amino-2-methylpropane, 2-amino-2-methylpropane, 1-aminopentane, 2-aminopentane, 3-aminopentane, neo-pentylamine, 1-aminohexane, 2-aminohexane, 1-aminoheptane, 2-aminoheptane, 1-aminooctane, 2-aminooctane, 1-aminononane, 1-aminodecane, 1-aminododecane, 1-aminotridecane, 1-aminotetradecane, 1-aminopentadecane, 1-aminohexadecane, 1-aminoheptadecane, 1-aminooctadecane, 1-aminoeicosane, and combinations thereof.

5. The method of claim 1 wherein a concentration of the phosphorus oxide compound is between about 0.1% by weight and about 5% by weight and a concentration of the nitrogen-containing organic compound is between about 0.1% by weight and about 1.0% by weight.

6. A method as set forth in claim 1 wherein at least one of $R_2$ and $R_3$ is hydrogen or the balancing cation.

7. A method for enhancing corrosion resistance, wear resistance, and contact resistance of a metal substrate comprising a copper or copper alloy layer on top of a surface of a metal base comprising a metal selected from the group consisting of iron, nickel, tin, zinc, chromium, titanium and precious metals, the method comprising:

exposing the copper or copper alloy layer to a composition comprising a phosphorus oxide compound;

a nitrogen-containing organic compound selected from the group consisting of primary amine, secondary amine, tertiary amine, and combinations thereof; and an alcohol having a boiling point of at least about 110° C.;

wherein said phosphorus oxide compound comprises a phosphonic acid compound comprising a carboxylic acid moiety, and wherein the nitrogen-containing organic compound has the following structure (III):

Structure (III)

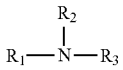

wherein $R_1$, $R_2$, and $R_3$ are each independently hydrogen or a hydrocarbyl having between one carbon atom and about 24 carbon atoms; and at least one of $R_1$, $R_2$, and $R_3$ is a hydrocarbyl having between one carbon atom and about 24 carbon atoms.

8. A method as set forth in claim 7 wherein said phosphorus oxide compound comprises a compound selected from the group consisting phosphonoacetic acid, phosphonopropionic acid, esters thereof, salts thereof, and combinations of said acids and/or their esters and salts.

9. A method as set forth in claim 1 wherein said copper or copper alloy layer is porous and phosphorus oxide of said composition penetrates into said pores to block subsequent access of corrosive materials through the pores to the base metal layer below the copper top coat layer.

10. A method as set forth in claim 1 wherein said composition comprises an alcohol having a boiling point of at least 150° C.

11. A method as set forth in claim 1 wherein said alcohol comprise 2-ethoxyethanol.

* * * * *